US009980562B2

(12) United States Patent
Schulman

(10) Patent No.: US 9,980,562 B2
(45) Date of Patent: May 29, 2018

(54) TRAY TABLE APPARATUS

(71) Applicant: Carl H. Schulman, Carlsbad, CA (US)

(72) Inventor: Carl H. Schulman, Carlsbad, CA (US)

( * ) Notice: Subject to any disclaimer, the term of this patent is extended or adjusted under 35 U.S.C. 154(b) by 0 days. days.

(21) Appl. No.: 15/437,774

(22) Filed: Feb. 21, 2017

(65) Prior Publication Data

US 2017/0156491 A1 Jun. 8, 2017

Related U.S. Application Data

(63) Continuation-in-part of application No. 14/803,878, filed on Jul. 20, 2015, now Pat. No. 9,572,425.

(60) Provisional application No. 62/026,062, filed on Jul. 18, 2014.

(51) Int. Cl.

| | |
|---|---|
| ***A47B 88/00*** | (2017.01) |
| ***A47B 23/00*** | (2006.01) |
| ***A47B 83/04*** | (2006.01) |
| ***A47B 46/00*** | (2006.01) |
| ***A47B 79/00*** | (2006.01) |

(52) U.S. Cl.

CPC ..... *A47B 23/00* (2013.01); *A47B 23/001* (2013.01); *A47B 46/00* (2013.01); *A47B 79/00* (2013.01); *A47B 83/045* (2013.01)

(58) Field of Classification Search

CPC ..... A47B 3/08; A47B 23/00; A47B 23/02; A47B 23/001; A47B 83/045; A47B 1/05; A47B 1/10

See application file for complete search history.

(56) References Cited

U.S. PATENT DOCUMENTS

| | | | |
|---|---|---|---|
| 1,220,578 | A | 3/1917 | Wise |
| 1,532,312 | A | 4/1925 | Llewellen |
| 1,737,441 | A | 11/1929 | Ulmer |
| 1,928,327 | A | 9/1933 | Bertinus |
| 2,525,975 | A | 10/1950 | Thomas et al. |
| 2,612,422 | A | 9/1952 | Sarkus |
| 2,819,141 | A | 1/1958 | Myer |
| 3,054,122 | A | 9/1962 | Sarkus |
| 3,805,711 | A | 4/1974 | Lakso |
| 5,606,918 | A | 3/1997 | Cauffiel |
| 6,253,688 | B1 | 7/2001 | Lor |

(Continued)

FOREIGN PATENT DOCUMENTS

| | | |
|---|---|---|
| AT | 102137 | 12/1925 |
| CN | 2669696 | 1/2005 |

(Continued)

*Primary Examiner* — Hanh V Tran

(74) *Attorney, Agent, or Firm* — The Belles Group, P.C.

(57) ABSTRACT

A tray table apparatus including a furniture support structure having a storage compartment, a tray table support assembly and a tray table coupled to the tray table. The tray table and the tray table support assembly are alterable between a first configuration having a first stowed position and a first deployed state and a second configuration having a second stowed position and a second deployed state. In the first and second stowed positions, the tray table and tray table support assembly are at least partially disposed within the storage compartment. In the first deployed state, the tray table is outside of the storage compartment and extends from a first side of the furniture support structure. In the second deployed state, the tray table is outside of the storage compartment and extends from a second side of the furniture support structure.

20 Claims, 23 Drawing Sheets

(56) References Cited

U.S. PATENT DOCUMENTS

| | | | |
|---|---|---|---|
| 6,412,423 | B1 | 7/2002 | Elizondo, Jr. |
| 6,722,681 | B1 | 4/2004 | Large |
| 7,398,737 | B1 | 7/2008 | Martellaro |
| 7,585,033 | B2 | 9/2009 | Holt |
| 7,849,789 | B1 | 12/2010 | Whelan |
| 9,010,885 | B2 | 4/2015 | Kahle |
| 2001/0052309 | A1 | 12/2001 | Allen |
| 2003/0000429 | A1 | 1/2003 | Ryburg |
| 2003/0076014 | A1 | 4/2003 | Kelley et al. |
| 2007/0034767 | A1 | 2/2007 | Mastropaolo et al. |
| 2009/0200437 | A1 | 8/2009 | Smed |
| 2012/0326472 | A1 | 12/2012 | Wu |

FOREIGN PATENT DOCUMENTS

| | | |
|---|---|---|
| CN | 202932323 | 5/2013 |
| CN | 203506037 | 4/2014 |
| CN | 203986898 | 12/2014 |
| DE | 218058 | 1/1910 |
| DE | 591011 | 1/1934 |
| EP | 1658784 | 4/2008 |
| FR | 1164493 | 10/1958 |

TRAY TABLE APPARATUS

CROSS REFERENCE TO RELATED APPLICATIONS

The present application is a continuation-in-part of U.S. patent application Ser. No. 14/803,878 filed Jul. 20, 2015, issuing as U.S. Pat. No. 9,572,425, which in turn claims the benefit of U.S. Provisional Patent Application Ser. No. 62/026,062, filed Jul. 18, 2014, the disclosures of which are incorporated herein by reference in their entireties.

FIELD OF THE INVENTION

The field of the present invention relates to tray tables, such as tray tables which may extend out over a bed for use as an in-bed table and may retract when not being used.

BACKGROUND OF THE INVENTION

Tray tables for use in the bed are common, and for people who choose Or need to eat, read, or work in bed, having a bedside tray table that extends out over the bed when needed and stows out of the way is an indispensable convenience. Such stowable tray tables are known in the art, however they often are attached to limitations that turn their use into a frustrating convenience. For example, some stowable tray tables have too many degrees of freedom, such as is seen in the tray table disclosed in U.S. Pat. No. 1,220,578, as all the degrees of freedom make the tray table too easily bumped out of the position in which it is set. Others have more limited degrees of freedom, but some of those degrees of freedom are nut easy to use for a person who is lying in the bed and needs to adjust the position of the bed tray, such as the tray table disclosed in U.S. Pat. No. 3,054,122.

For a person who is lying in bed, having a tray table with limited degrees of freedom is acceptable when the degrees of freedom provided make the tray table easy to use for a person lying, in the bed and at the same time provide a sufficiently stable platform which may be used and not too easily bumped out of position. It is therefore desirable that a stowable tray table for use in the bed meet a balance between usability and stability. At the same time, another desirable feature for some stowable tray tables is that they can be stowed entirely out of sight when not in use.

SUMMARY OF THE INVENTION

The present invention is directed toward a tray table apparatus which includes a tray table which is movable between a stowed position to a deployed position. When not in use, the tray table may be stowed out of the way in the stowed position. The stowable tray table is made to be particularly easy to use by a person lying in a bed. When in use, the tray table provides adjustment mechanisms by which a person may easily adjust at least two degrees of freedom: the height of the tray table above another surface, such as a bed, and the lateral position of the tray table between, such as between the head and foot of a bed.

In a first separate aspect of the present invention, a tray table apparatus includes: a tray table; and a tray table support assembly coupled to the tray table, the tray table and the tray table support assembly configured to transition between a stowed position and a deployed position. The tray table support assembly includes: a support shelf; a support arm having a first end pivotably coupled to the support shelf so as to be pivotable about a first pivot axis and a second end, the tray table pivotably coupled to the second end of the support arm so as to be pivotable about a tray table pivot axis; and an adjustable pivot stop positioned to limit pivot movement of the support arm about the first pivot axis in the deployed position, such that a selected adjustment position of the adjustable pivot stop determines an angle of inclination formed between the support arm and the support shelf.

In a second separate aspect of the present invention, a tray table apparatus includes: a tray table; and a tray table support assembly coupled to the tray table, the tray table and the tray table support assembly configured to transition between a stowed position and a deployed position. The tray table support assembly includes: a support shelf; and a support arm, the support arm having a first end pivotably coupled to the support shelf so as to be pivotable about a first pivot axis and a second end, the tray table pivotably coupled to the second end of the support arm so as to be pivotable about a tray table pivot axis and translatable, relative to the support arm, in a direction parallel to the tray table pivot axis.

In a third separate aspect of the present invention, a tray table apparatus includes: a tray table having a first end and a second end; and a tray table support assembly coupled to the tray table, the tray table and the tray table support assembly being configured to transition between a stowed position and a deployed position. The tray table support assembly includes: a support shelf:, a support arm having a first end pivotably coupled to the support shelf so as to be pivotable about a first pivot axis and a second end, the first end of the tray table pivotably coupled to the second end of the support arm so as to be pivotable about a tray table pivot axis; and a support leg pivotably coupled to the tray table adjacent the second end of the tray table, the support leg configured to be adjustable in length.

In a fourth separate aspect of the present invention, a tray table apparatus includes: a support structure; a tray table; and a tray table support assembly coupled to the tray table and mounted to the support structure, the tray table and the tray table support assembly configured to transition between a stowed position and a deployed position. The tray table support assembly includes: a support shelf having a first end and a second end opposite the first end; and a support arm having a first end and a second end, the tray table pivotably coupled to the second end of the support arm so as to be pivotable about a tray table pivot axis. The support arm is alterable between: (1) a first state in, which the first end of the support arm is pivotably coupled to the support shelf so as to be pivotable about a first pivot axis between a first folded position in which the support arm lies atop the support shelf and a first unfolded position in which the support arm extends in a first inclined orientation such that the second end of the support arm is located laterally beyond the first edge of the support shelf; and (2) a second state in which the first end of the support arm is pivotably coupled to the support shelf so as to be pivotable about a second pivot axis between a second folded position in which the support arm lies atop the support shelf and a second unfolded position in which the support arm extends in a second inclined orientation such that the second end of the support arm is located laterally beyond the second edge of the support shelf.

In a fifth separate aspect of the present invention, a tray table apparatus includes: a tray table having a first end and a second end; a telescoping leg pivotably affixed adjacent the second end of the tray table; a handle affixed to the second end of the tray table; and a tray table support assembly coupled to the tray table, the tray table and the tray table support assembly configured to transition between a stowed position and a deployed position. The tray table support assembly includes: a support shelf having a lateral centerline, a first pivot axis, and a second pivot axis, with the first pivot axis and the second pivot axis being symmetrical to each other with respect to the lateral centerline; a support arm including at least one first pivot member pivotably coupled to the support shelf along one of the first pivot axis and the second pivot axis, and a second pivot member pivotably coupled adjacent to the first end of the tray table; an adjustable pivot stop positioned to limit pivot movement of the support arm with respect to the support shelf in the deployed position, such that an adjustment position of the adjustable pivot stop determines a height of the tray table in the deployed position; a pivot block pivotably coupling the second pivot member of the support arm to the tray table, wherein the pivot block is configured to be slidable along a longitudinal axis of the second pivot member; and a support leg pivotably coupled to the tray table adjacent the second end, the support leg being configured to be adjustable in length.

In a sixth separate aspect of the present invention, a tray table apparatus includes: a furniture support structure having a storage compartment; and a tray table support assembly coupled to a tray table and to the furniture support structure, the tray table and the tray table support assembly alterable between: (1) a first configuration in which the tray table and the tray table support assembly can be transitioned between: (a) a first stowed position in which the tray table and the tray table support assembly are at least partially disposed within the storage compartment, and (b) a first deployed state in which the tray table is outside of the storage compartment and extends from a first side of the furniture support structure so that one or more articles can be supported by the tray table; and (2) a second configuration in which the tray table and the tray table support assembly can be transitioned between: (a) a second stowed position in which the tray table and the tray table support assembly are at least partially disposed within the storage compartment, and (b) a second deployed state in which the tray table is outside of the storage compartment and extends from a second side of the furniture support structure so that one or more articles can be supported by the tray table, the second side being opposite the first side.

In a seventh separate aspect of the present invention, a tray table apparatus includes: a furniture support structure having a storage compartment; and a tray table support assembly coupled to a tray table and to the furniture support structure, the tray table and the tray table support assembly alterable between: (1) a stowed position in which the tray table and the tray table support assembly are at least partially disposed within the storage compartment; (2) a first deployed state in which the tray table is outside of the storage compartment and extends from a first side of the furniture support structure so that one or more articles can be supported by the tray table; and (3) a second deployed state in which the tray table is outside of the storage compartment and extends from a second side of the furniture support structure so that one or more articles can be supported by the tray table, the second side being opposite the first side.

Accordingly, an improved tray table apparatus having a stowable tray table is disclosed. Advantages of the improvements will be apparent from the drawings and the description of the preferred embodiment.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
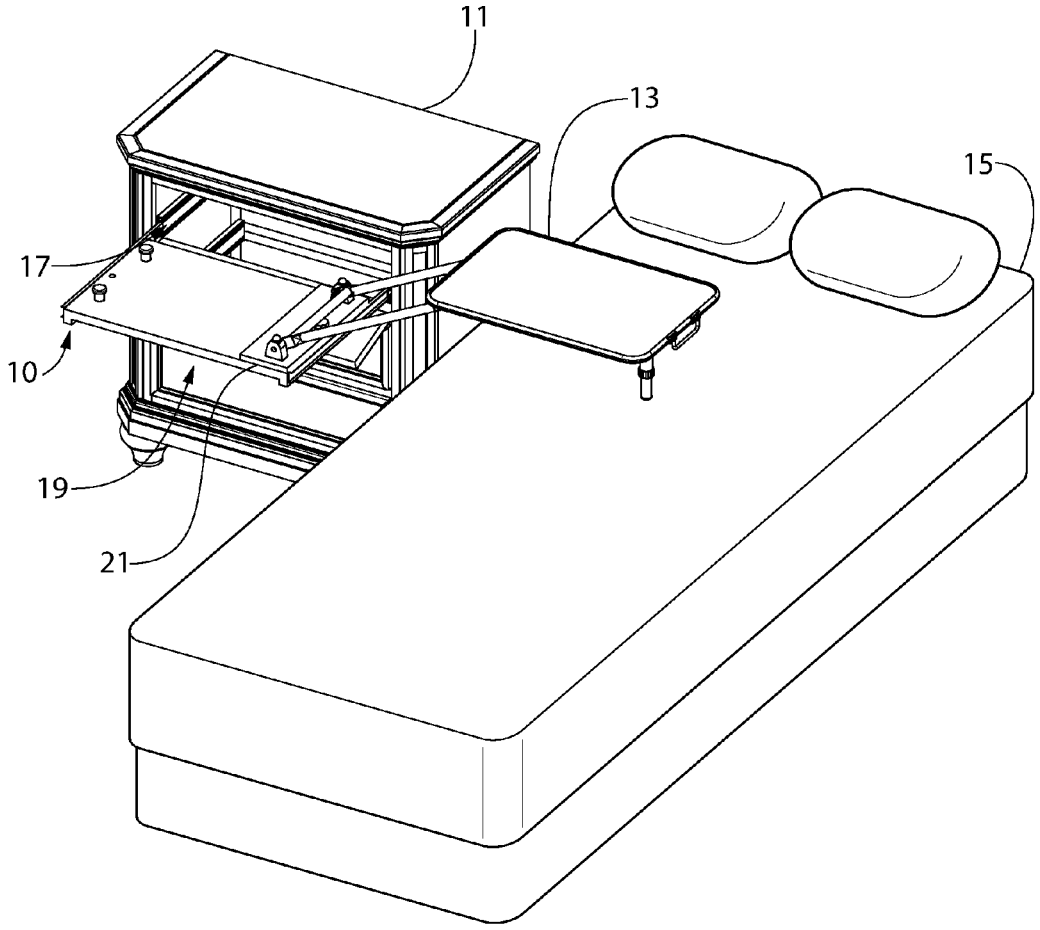
FIG. 1 is a perspective view of a first embodiment of a tray table apparatus, coupled to a night table, having a stowable tray table shown in the deployed position over a bed.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid, attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

As used herein, the term "night table" refers to any furniture that may be placed and/or used next to a bed. By way of example, a night table may be a free-standing piece of furniture having one or more storage compartments, such as a chest of drawers, or it may be a piece of furniture that is built-in to a wall or another piece of furniture, such as a bed or headboard. In addition, Those of skill in the art will recognize that the terms "night table," "nightstand," and "bedside table" are all used within the industry as standard descriptive names for the same type of furniture.

Turning in detail to the drawings, FIG. 1 shows an embodiment of a tray table apparatus 10 coupled to a night table 11. The tray table apparatus 10 includes a stowable tray table 13 shown in a first deployed position over a bed 15. The first deployed position may also be known as a first deployed state. In the embodiment shown, the night table 11 includes an upper storage compartment 17 and a lower storage compartment 19, with the tray table apparatus 10 being stowed in the upper storage compartment 17. The night stand 11 and the upper and lower storage compartments 17 are intended to be non-limiting features of the invention, unless otherwise recited in the claims. As such, the night stand 11, along with its upper and lower storage compartments 17, 19, and the bed 15 are shown and described herein to illustrate one context, amongst the many possible, in which the tray table apparatus 10 may be used.

The tray table apparatus 10 includes a tray table support assembly 21 which is coupled to and provides support for the tray table 13. The tray table apparatus 10 transitions between the first deployed position and a first stowed position as illustrated in FIGS. 1-5. When the tray table support assembly 21 is in the stowed position, both the tray table 13 and the tray table support assembly 21 are stowed within the, upper storage compartment 17.

Figure 2:
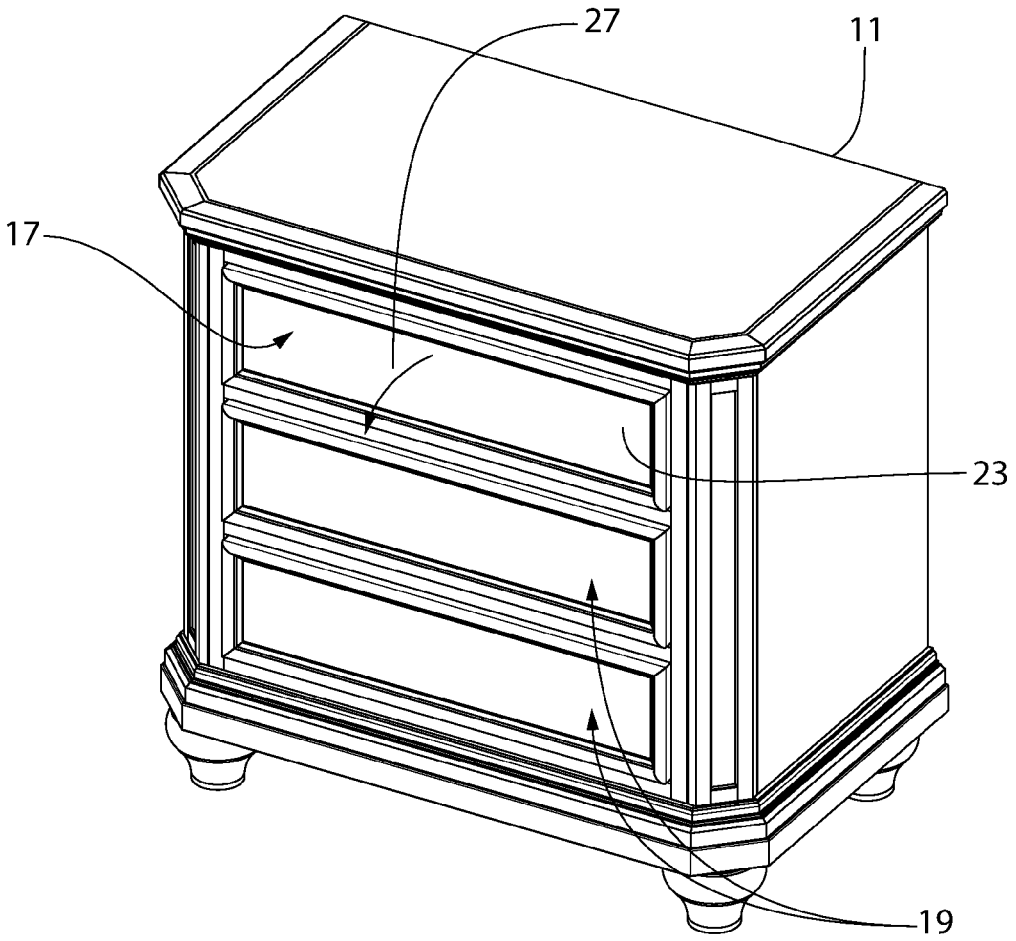
FIG. 2 is a perspective view of the tray table apparatus of FIG. 1 with the tray table in the stowed position.

The lower storage compartment 19 of the night stand 11 is shown as two drawers in FIG. 2. In certain embodiments, the lower storage compartment 19 may be one or more open shelves, one or more drawers, one or more cabinets, or any combination thereof. In addition, the lower storage compartment 19 may be sub-divided into two or more separate storage compartments. The lower storage compartment 19 may take any form desired for a particular implementation. In certain other embodiments, the lower storage compartment may be omitted entirely, such as in an implementation of a night table which is built-in to supported by a wall or other piece of furniture. In certain embodiments, the tray table apparatus 10 may be coupled to other types of furniture or support structures, some of which may not include any separate or distinct storage compartments.

Figure 3:
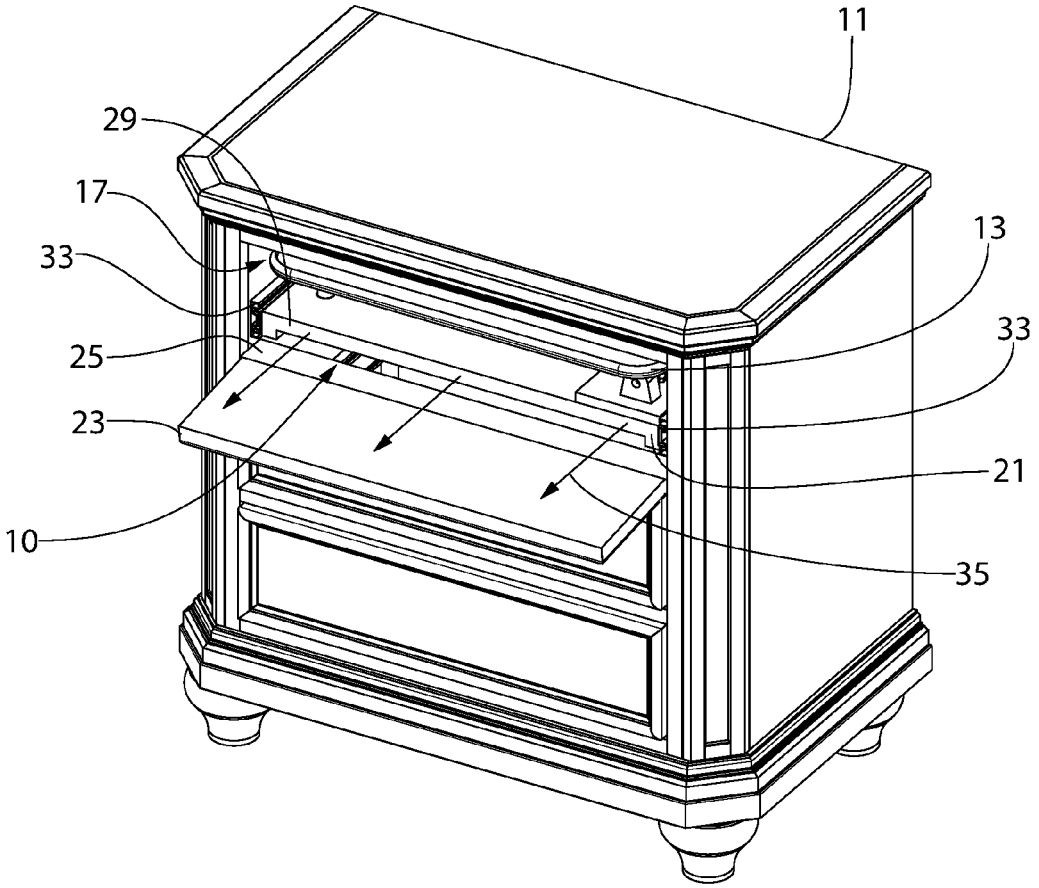
FIG. 3 is a perspective view of the tray table apparatus of FIG. 1 with the upper storage compartment of the night stand open so that the tray table may be transitioned from the stowed position to the deployed position.

As shown in FIG. 2, the upper storage compartment 17 of the night stand 11 includes a decorative facing 23 which serves to hide the tray table apparatus 10 stowed within the upper storage compartment 17 in the stowed position. In certain embodiments, the decorative facing 23 may be omitted. As shown in FIGS. 2 and 3, the decorative facing 23 is pivotably affixed to a cross member 25 within the night table 11. The decorative facing 23 may be pivoted in the direction shown by the arrow 27 to open the upper storage compartment 17, thereby giving a user access to the tray table apparatus 10 stowed therein. In alternative embodiments, the decorative facing 23 may be directly affixed to the tray table support assembly 21, thereby eliminating the need to pivot the decorative facing 23 prior to moving the tray table apparatus 10 out of the upper storage compartment 17.

Figure 4:
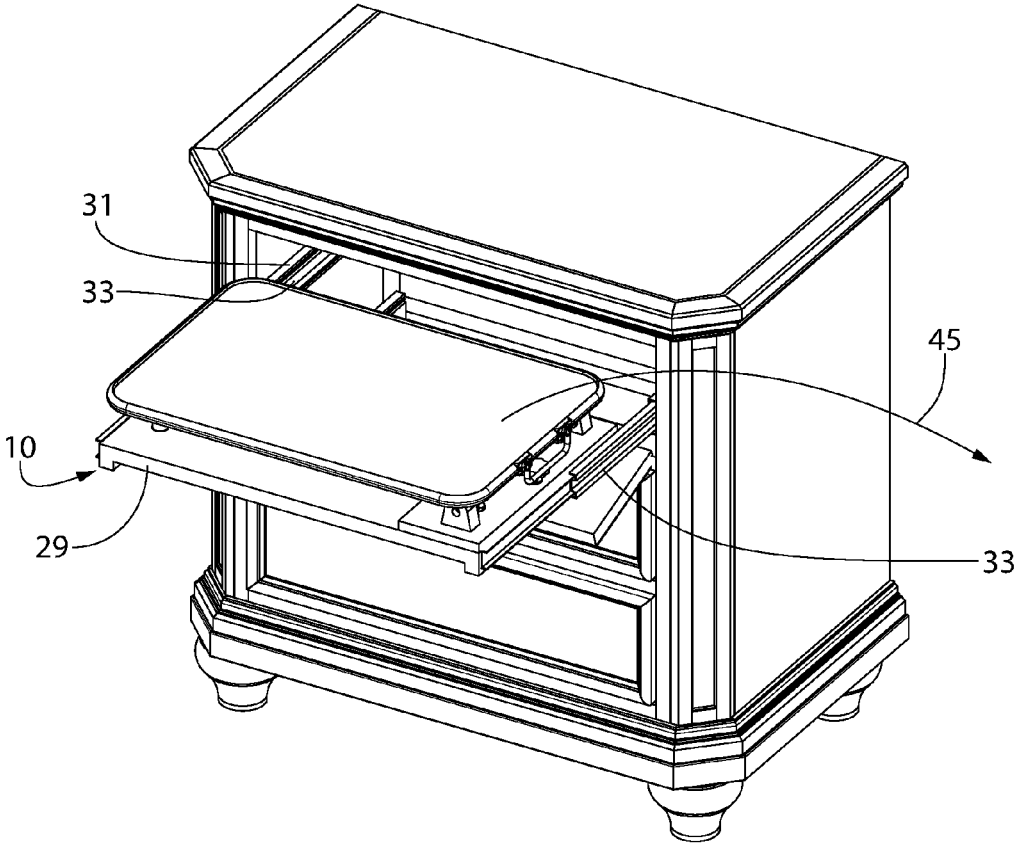
FIG. 4 is a perspective view of the tray table apparatus of FIG. 1 with the tray table in an intermediate position between the stowed position and the deployed position.

The tray table support assembly 21 includes a support shelf 29 which is coupled to the internal frame 31 of the night table 11 by drawer slides 33. The drawer slides 33 enable the stowed tray table apparatus 10 to slide out of the upper storage compartment 17 in the direction shown by arrows 35. In certain embodiments, the drawer slides 33 may be any appropriate type of mechanism which enables the tray table apparatus 10 to slide out from the upper storage compartment 17. The tray table apparatus 10 is shown in FIG. 4 in an intermediate position, outside of the upper storage compartment 17, during the transition between the first stowed position and the first deployed position. In this intermediate position, and also in the first stowed position, the tray table support assembly 2I is in a folded position.

More particularly, on the drawer slides 33, the support shelf 29 translates, relative to the night stand 11, between a retracted position, in which the tray table support assembly 21 is in the first stowed position within the upper storage compartment 17, and an extended position, in which the tray table support assembly 21 is in an intermediate position, before transitioning to the first deployed position. During translation of the support shelf 29 from the extended position to the retracted position, and vice versa, the support shelf 29 travels in a plane of motion which is parallel to the pivot axes PA1, PA2, shown in FIG. 5.

Figure 5:
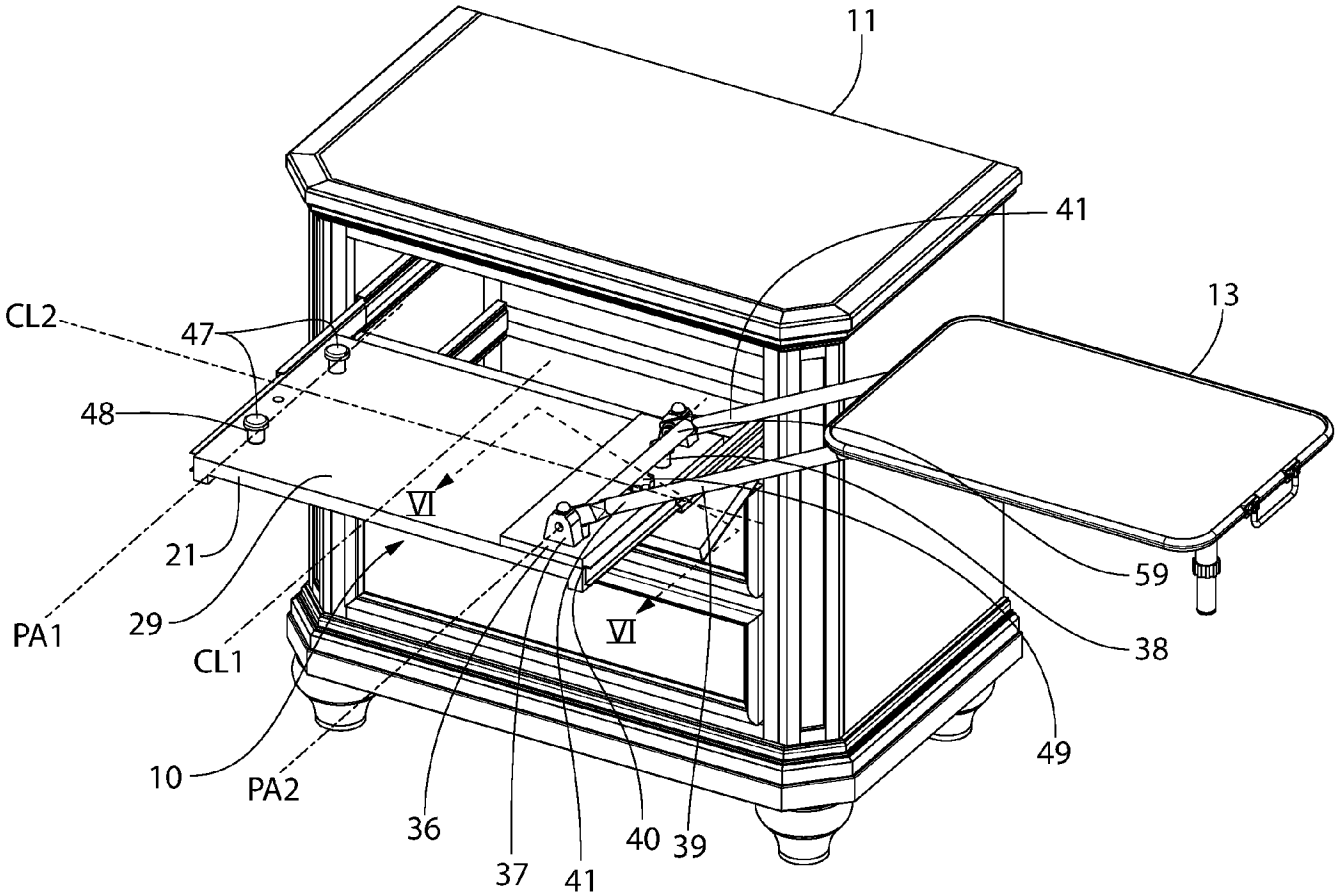
FIG. 5 is a perspective view of the tray table apparatus of FIG. 1 with the tray table in the deployed position.

The tray table apparatus 10 is shown in the first deployed position in FIG. 5. The tray table support assembly 21 includes a base plate 36 affixed to the support shelf 29 and pivot blocks 37 mounted to the base plate 36. The base plate 36 is removably affixed to the support shelf 29 by threaded knobs 38 extending through the base plate 36 and into threaded receptacles (shown as threaded receptacles 42 in FIG. 11B) within the support shelf. A support arm 39 has a first end 40 with pivot members 41 pivotably coupled to the pivot blocks 37. As described in greater detail below, the base plate 36 may be coupled to the support shelf 29 to create one of two possible states for the tray table apparatus 21. In the first state of the tray table apparatus 21, the base plate 36 is coupled to the support shelf 29 in a first position so that the pivot blocks 37 form a first pivot axis PA1, and in the second state of the tray table apparatus 21, the base plate 36 is coupled to the support shelf 29 in a second position so that the pivot blocks 37 form a second pivot axis PA2. As shown in FIG. 5, the base plate 36 is coupled to the support shelf 29 in the second position.

Thus, FIG. 5 demonstrates the tray table support assembly 21 and the tray table 13 in a first configuration such that in the first deployed position, the tray table 13 extends beyond a first side of the night stand 11. However, it is possible to reconfigure the tray table apparatus 21 and the tray table 13 into a second configuration such that the tray able 13 extends beyond a second side of the night stand 11 by reversing the base plate 36 so that pivot blocks 37 rotate about the first pivot axis PA1 instead of the second pivot axis PA2.

In the embodiment shown, the pivot members 41 form sides of the support arm 39, and each pivot member 41 is positioned orthogonal to the pivot axis PA2. In certain embodiments, the support arm 39 may include at least one pivot member, and the at least one pivot member may be positioned at any angle to the pivot axis PA2 so as to allow the pivot motion when the tray table apparatus 10 transitions from the first stowed position to the first deployed position and vice versa.

With the pivot members 41 pivotably affixed to the pivot blocks 37, the support arm 39 is able to pivot with respect to the support shelf 29 for transitioning the tray table apparatus 10 between the intermediate position and the first deployed position. As is discussed in greater detail below, the support arm 39 is also pivotably coupled to the tray table 13, so that when the support arm 39 moves during the transition between the intermediate position and the first deployed position (as shown by arrow 45), the tray table 13 simultaneously can be pivoted with respect to the support arm 39. The tray table support assembly 21 also includes support blocks 47 secured into threaded receptacles (shown as threaded receptacles 44 in FIG. 11B), and the support blocks 47 serve to support the tray table 13 when the tray table apparatus 10 is in the first stowed position or in the intermediate position.

Figure 11A:
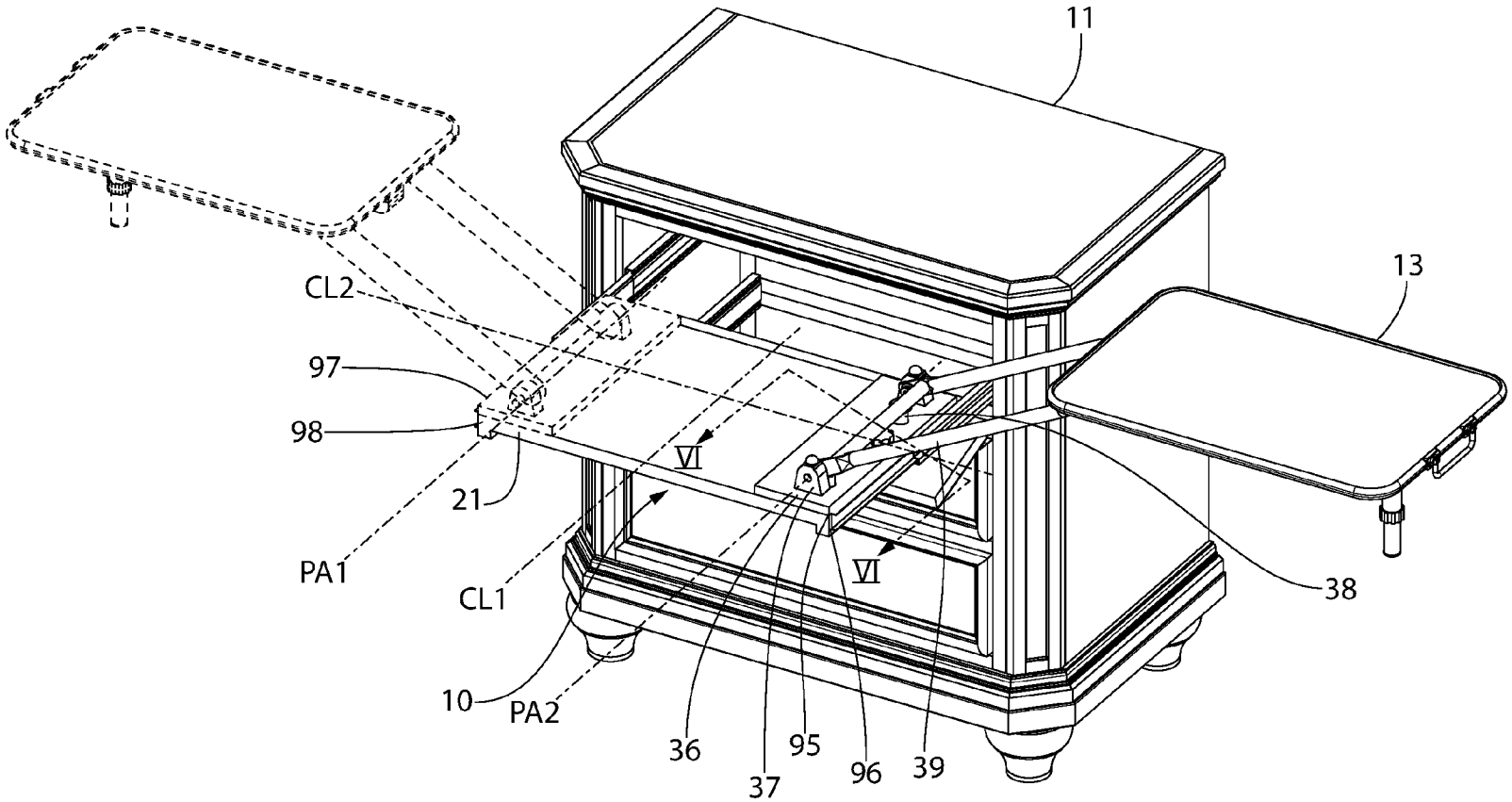
FIG. 11A is a perspective view of the tray table apparatus of FIG. 1 showing the reconfigurability of the tray table apparatus.
Figure 11B:
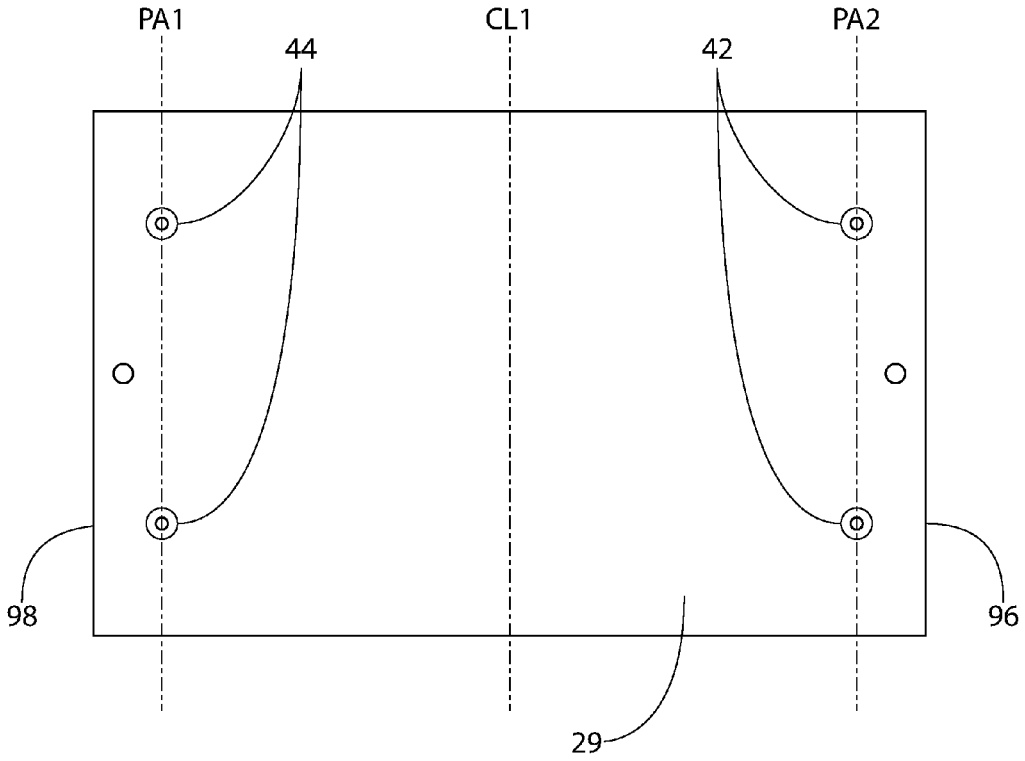
FIG. 11B is a top elevation view of the support shelf for the tray table apparatus of FIG. 1.

The threaded receptacles used to secure the base plate 36 to the support shelf 29 and the threaded receptacles used to secure the support blocks 47 to the support shelf 29 are symmetrically located about a lateral centerline CL1 and a longitudinal centerline CL2 of the support shelf 29. Symmetric placement of the respective threaded receptacles, along with the threaded knobs 38 used to secure the base plate 36 to the support shelf 29 allows the base plate 36 to be secured to either side of the support shelf 29. This configuration also permits the user to easily and quickly reconfigure the tray table apparatus 10 from the first configuration to the second configuration. The tray table apparatus 10 can be used in the first deployed position or in a second deployed position, with the tray table 13 extended out on either side of the tray table support assembly 21 (as is shown in FIG. 11A). This provides the tray table apparatus 10 with easy symmetrical reconfigurability, such that the two optional deployed positions for the tray table apparatus 10 are symmetrical about the lateral centerline CL1 of the support shelf 29.

With the support blocks 47 in place, when the tray table apparatus 10 is in the first stowed position or in the intermediate position, the tray table 13 and the support shelf 29, and the support arm 39 are positioned in a plurality of parallel planes, with a first plane defined by the tray table 13, a second plane defined by the support shelf 29, and a third plane defined by the support arm 39. In certain embodiments, the support blocks 47 may include resilient caps 4S to aid in reducing wear and tear on the underside of the tray table 13 when the tray table apparatus 10 is in the first stowed position or in the intermediate position.

Figure 6:
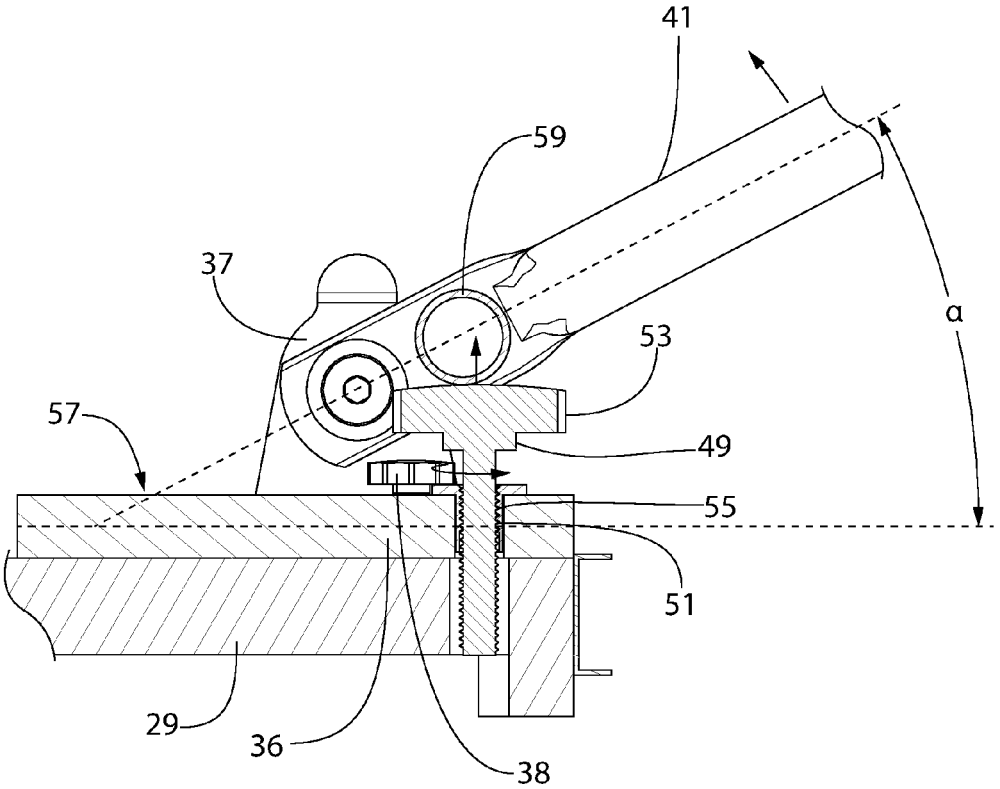
FIG. 6 is a sectional view of a portion of the tray table support assembly of the tray table apparatus of FIG. 1, showing the adjustable pivot stop.

The tray table support assembly 21 also includes a pivot stop 49, as is shown in FIGS. 5 and 6. In the embodiment shown, the pivot stop 49 is a screw element 51 coupled to a knob 53. The screw element 51 is secured into a threaded receptacle 55 included as part of the base plate 36, with the handle extending above the top surface 57 of the base plate 36. The support arm 39 includes a cross member 59 extending between the two pivot members 41, and the cross member 59 is positioned such that when the tray table support assembly 21 is in the first or second deployed position, the cross member 59 comes into contact with the knob 53. Rotation of the screw element 51 adjusts the height of the knob 53 above the top surface 57 of the base plate 36. With this configuration, the knob 53 may have a selected adjustment position which serves to limit the pivot motion of the support arm 39. The pivot motion of the support arm 39 is limited to a pivot angle $\alpha$ with respect to the plane of the base plate 36. In the first or, second deployed position, the pivot angle $\alpha$ determines an angle of inclination formed between the support arm 39 and the support shelf 29. Thus, the height of the knob 53 above the top surface 57 of the base plate 36 therefore serves to determine the height of one side of the tray table 13, e.g., the height of the one side of the tray table 13 above the bed, when the tray table support assembly 21 is in the first or second deployed position. As described below, the height of other side of the tray table 13 is determined by a telescoping leg.

Figure 7:
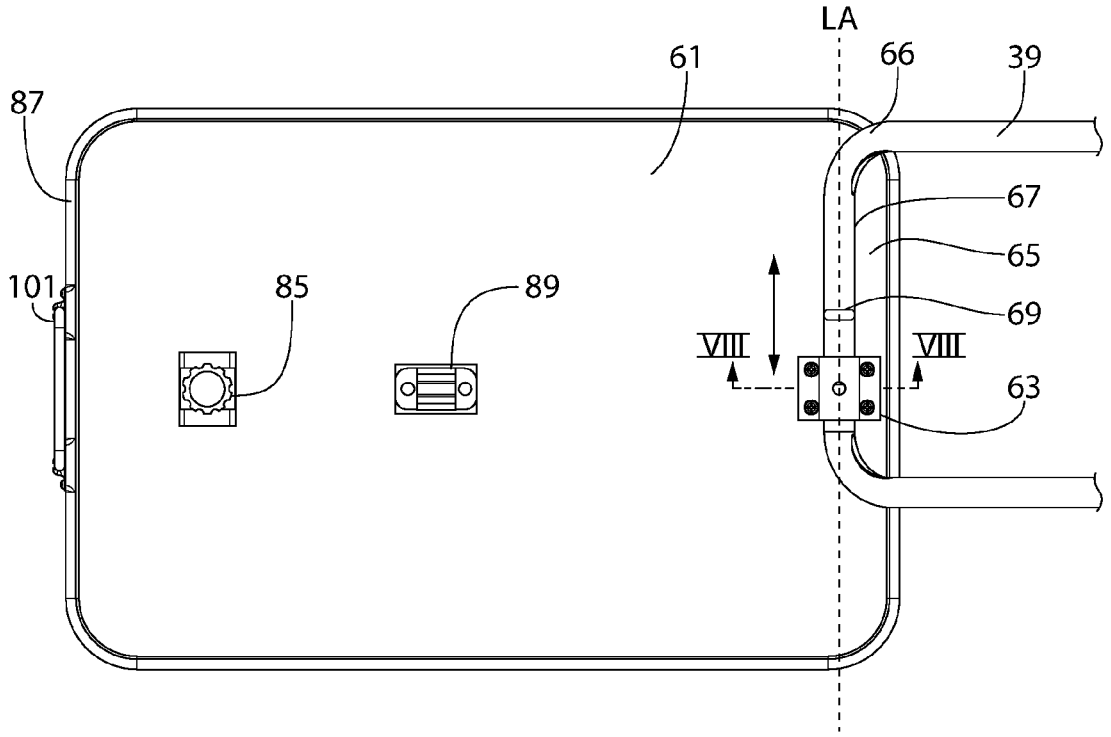
FIG. 7 is an elevation view of the bottom of the tray table of the tray table apparatus of FIG. 1.
Figure 8:
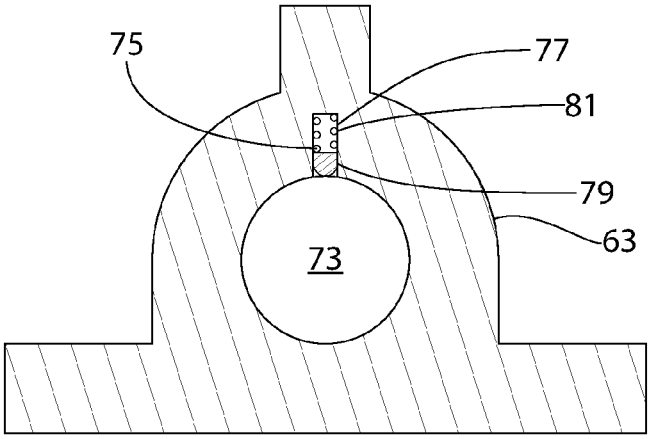
FIG. 8 is a sectional view of the pivot block along the line VIII-VIII of FIG. 7.

The bottom surface 61 of the tray table 13 is shown in FIG. 7. A tray pivot block 63 is mounted to the bottom surface 61 adjacent a first end 65 of the tray table 13. The tray pivot block 63 couples with a pivot member 67 of the support arm 39 to pivotably couple the support arm 39 to the tray table 13. The pivot member 67 extends along a longitudinal axis LA, and the tray pivot block 63 is movable by sliding along the longitudinal axis LA. In terms of the tray table 13 being placed over a bed, the sliding of the tray table 13, with respect to the support arm 39, means that the tray table may be moved toward and away from the foot/head of the bed. The support arm 39 includes an indent 69 at roughly a middle portion thereof to mark a centered position for the tray table 13. As is shown in FIG. 8, the tray pivot block 63 includes a through hole 73 for receiving the pivot member 67 of the support arm 39. Within the through hole 73, the tray pivot block 63 houses a biased ball assembly 75 within a recess 77. The biased ball assembly 75 includes a ball 79 biased by a spring 81 toward the center of the through hole 73, so that when the tray table 13 slides along the longitudinal axis LA, the biased ball 77 slightly catches within the indent 69 to alert the user that the tray table 13 is at the centered position. By enabling the user to more easily identify the centered position of the tray table 13, it is easier for the user to transition the tray table apparatus 10 from the deployed position to the stowed position and vice versa.

A support leg 85 is mounted adjacent and pivotably coupled to the bottom surface 61 adjacent the second end 87 of the tray table 13. A leg clip 89 is also mounted to the bottom surface 61 of the tray table 13. The support leg 85 is pivotable from a position parallel with the bottom surface 61 of the tray table 13 to a position that is orthogonal to the bottom surface 61. In the parallel position, the leg clip 89 engages the support leg 85 and secures support leg 85 to the bottom surface 61 of the tray table 13. In order to transition the tray table apparatus 10 into the first or second stowed position from the first or second deployed position respectively, the support leg 85 is engaged with the leg clip 89 in the parallel position. When the tray table apparatus 10 is in the first or second deployed position, the support leg 85 may be pivoted to the orthogonal position so that the support leg 85 can rest on the bed to provide additional stability and support to the tray table 13.

Figure 9:
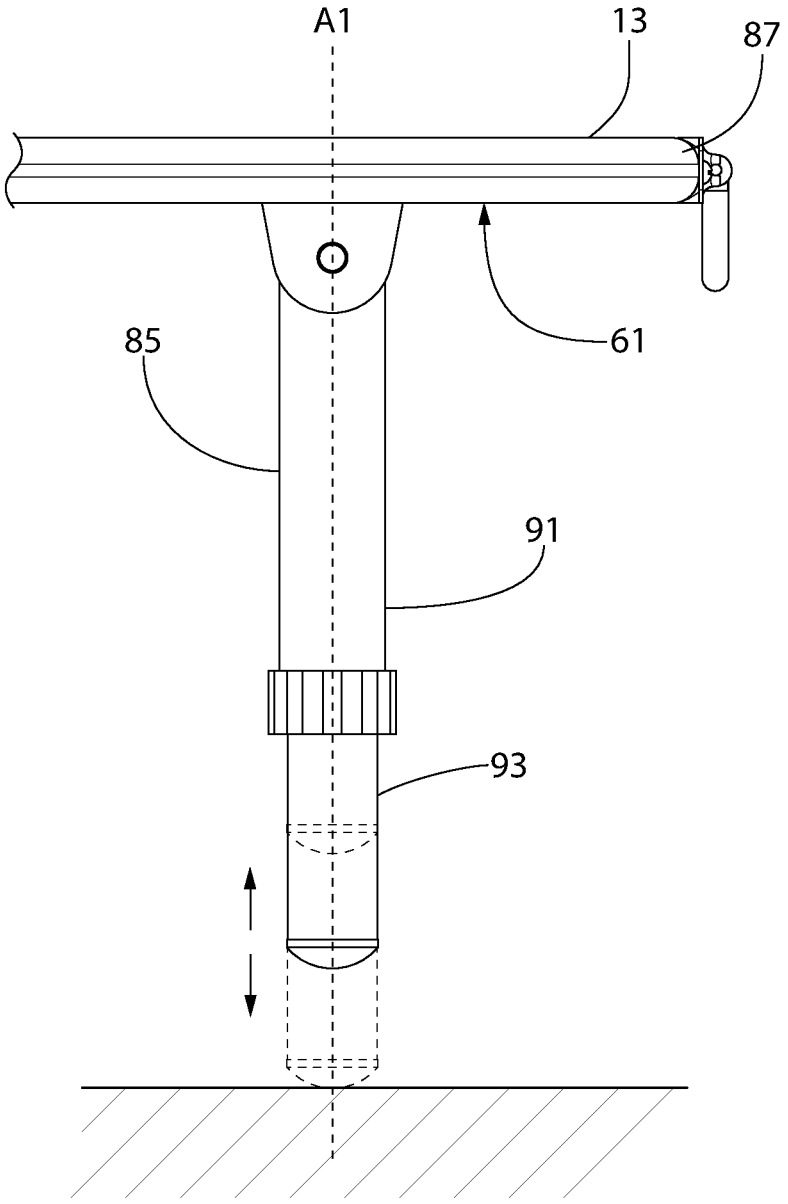
FIG. 9 is an elevation view of the support leg for the tray table of the tray table apparatus of FIG. 1.

As shown in FIG. 9, the support leg 85 is telescoping and includes a first leg segment 91 and a second leg segment 93, with the second leg segment 93 being movable along the leg axis A1 relative to the first leg segment 91. The support leg 85 may also include an appropriate locking mechanism, such as a clamp, a thumb screw, or the like, to secure the relative positions of the first and second leg segments 91, 93. By moving the second leg segment 93 along the leg axis A1, the support leg 85 is adjustable in length so that the second end 87 of the tray table 13 may be set at a desired height by a user.

Figure 10:
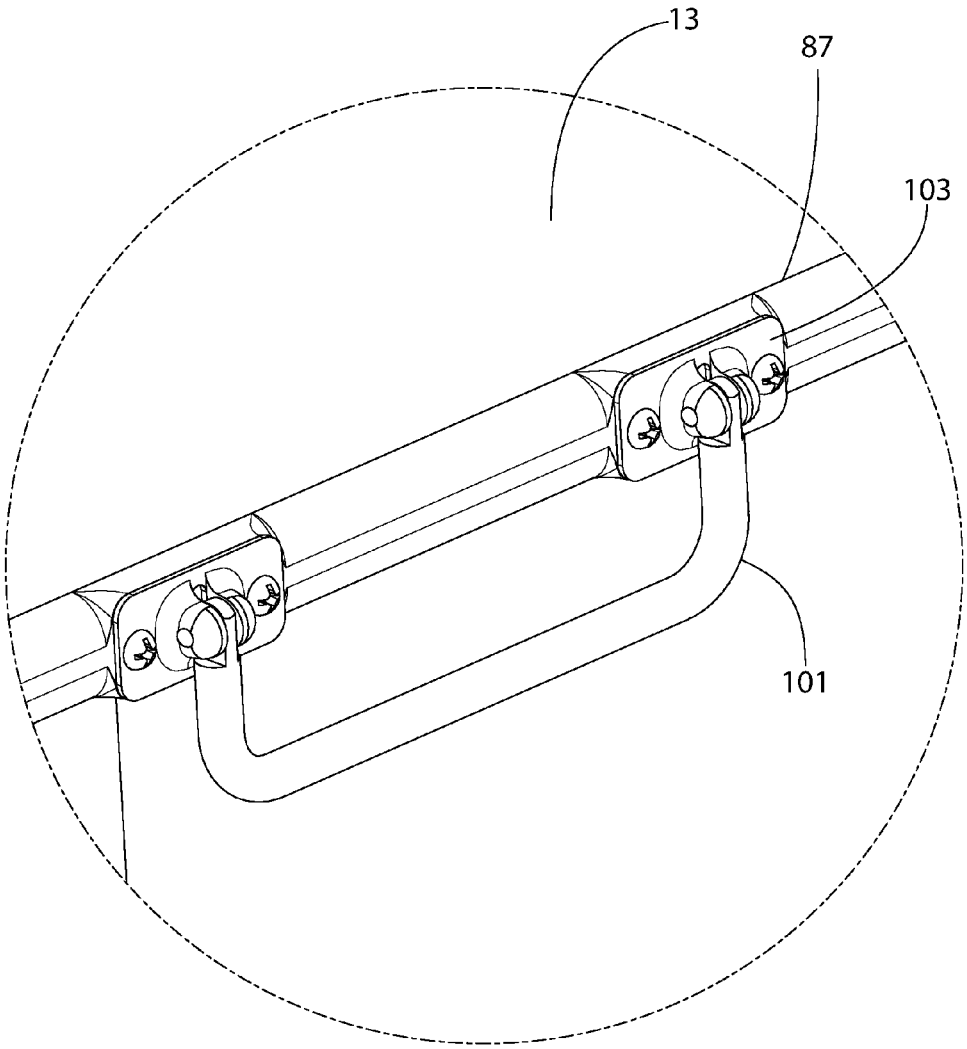
FIG. 10 is a perspective view of the handle for the tray table of the tray table apparatus of FIG. 1.

A handle 101 is affixed to the second end 87 of the tray table 13, as is shown in FIGS. 7 and 10. The handle 101 is mounted to the second end 87 of the tray table 13 with pivot brackets 103 which permit the handle 101 to pivot with respect to the tray table 13 and allow gravity to provide a downward bias to the pivot position of the handle 101. With the handle 101 configured in this manner, it facilitates transitioning the tray table apparatus 10 from the intermediate position to the deployed position, and at the same time, the handle 101 automatically hangs out of the way for placing the tray table apparatus 10 in the stowed position. Having the handle 101 positioned on the side of the tray table 13 makes it particularly easier for a user lying in a bed to transition the tray table apparatus 10 from the intermediate position to the deployed position.

It will be appreciated that the tray table apparatus 10 may be coupled to any support structure other than a night stand or furniture. For example, in certain embodiments, the tray table apparatus 10 may be coupled to a cart with wheels to provide a deployable tray table that may be used in any convenient circumstances. It will also be appreciated that the tray table apparatus 10 may be used in other circumstances which are not adjacent a bed. In addition, in certain embodiments the tray table apparatus 10 may be coupled to a support structure which may or may not include a storage compartment for stowing the tray table apparatus 10. In such embodiments without a storage, compartment, the stowed position and the intermediate position of the tray table apparatus 10 may be one and the same position. In certain embodiments, such as one in which a storage compartment which opens from above the tray table apparatus 10, instead of opening from on the side, is used for the stowing the tray table apparatus 10, the tray table apparatus 10 may have no intermediate position, instead transitioning directly from the stowed position to the deployed position. In most embodiments, the ability to quickly and easily symmetrically reconfigure the deployed position of the tray table support assembly is anticipated to provide a versatility that is heretofore not seen in the prior art.

FIG. 11A shows the reconfigurability of the tray table apparatus 10. The support shelf 29 of the tray table support assembly 21 includes two pair of pivot axes PA1, PA2, each representing the positions of the pivot blocks 37 for each of the two deployment configurations. The pivot axes PA1, PA2 are equidistant from the lateral centerline CL1 of the support shelf 29. To reconfigure the tray table apparatus 10, the base plate 36 is released from the first side 95 of the support shelf 29 by releasing the threaded knobs 38 from the support shelf 29 and affixing the base plate 36, along with the coupled pivot blocks 37, support arm 39, and the tray table 13, to the second side 97 of the support shelf 29. Thus, as shown and described, the tray table support assembly 21 may be easily and quickly reconfigured from a first configuration to a second configuration. This allows switching from one of the deployed positions to the other, such as, for example, to be used with a bed positioned on either side of the night table 11.

Described another way, as part of the reconfiguration, the support arm 39 is alterable between a first state and a second state. In the first state, the first end 40 of the support arm 39 is pivotably coupled to the support shelf 21 so as to be pivotable about a the pivot axis PA2 between a first folded position and a first unfolded position in which the support arm 39 extends in a first inclined orientation such that the second end 66 of the support arm 39 is located laterally beyond the first edge 96 of the support shelf 29. The tray table 13 extends from a first side of the night table 11. In the second state, the first end 40 of the support arm 39 is pivotably coupled to the support shelf 21 so as to be pivotable about a the pivot axis PA1 between a second folded position and a second unfolded position in which the support arm 39 extends in a second inclined orientation such that the second end 65 of the support arm 39 is located laterally beyond the second edge 98 of the support shelf 29. The, tray table 13 extends from a second side of the night table 11. Comparing the first state and the second state of the support arm 39, the first folded state of the support arm 39 is symmetrical about the lateral centerline CL1 of the support shelf 29 with the second folded state of the support arm 39. Similarly, the first extended position of the support arm 39 is symmetrical about the lateral centerline CL1 of the support shelf 29 with the second extended position of the support arm 39.

Figure 12:
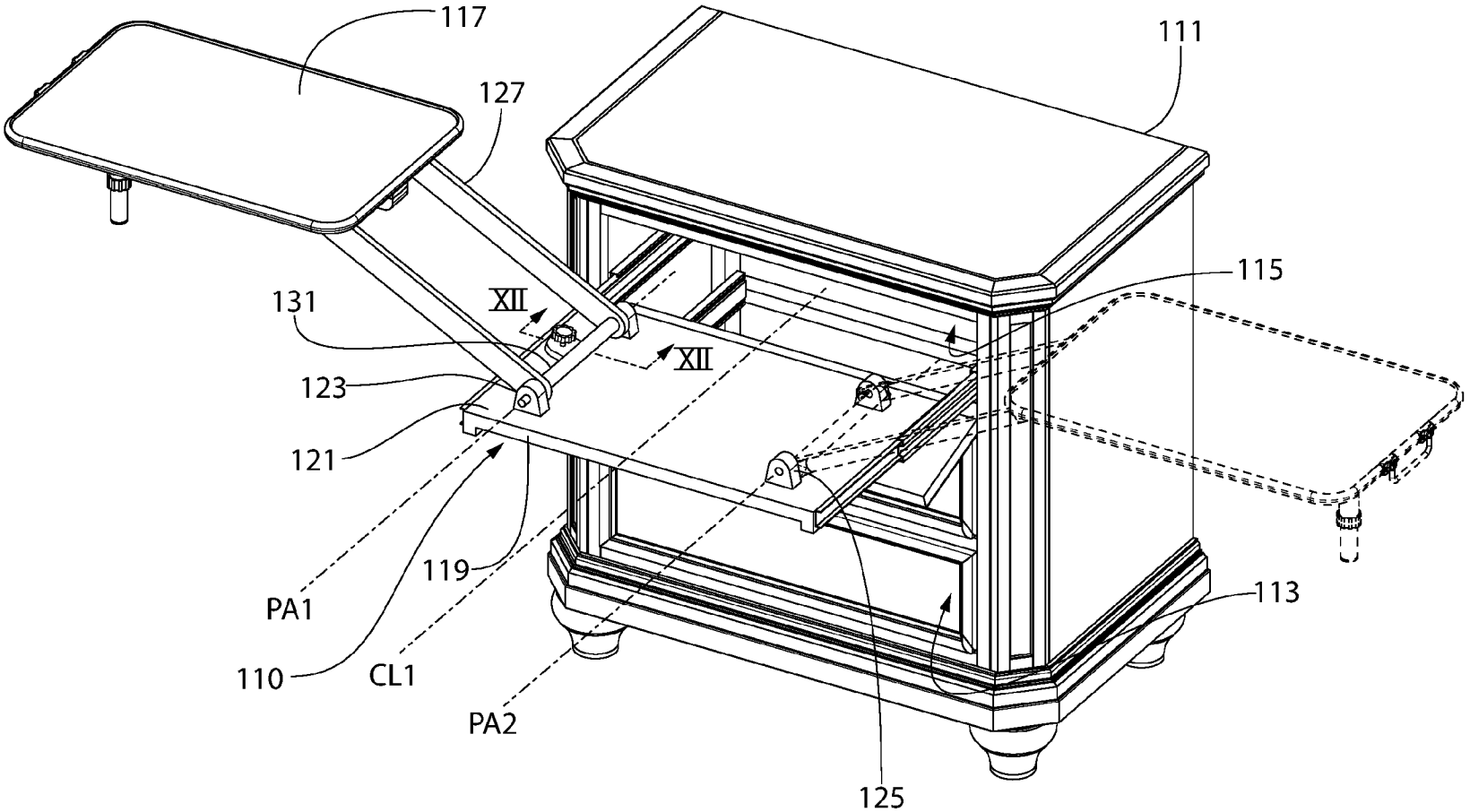
FIG. 12 is a perspective view of a second embodiment of a tray table apparatus having a stowable tray table.

A second embodiment of a tray table apparatus 110, again shown in context coupled to a night table 111, is illustrated in FIG. 12. This night table 111 also includes a lower storage compartment 113 and an upper storage compartment 115 As with other embodiments of the tray table apparatus 110 described herein, the tray table apparatus 110 may be coupled to any structural support other than a night stand or furniture. The tray table apparatus 110 includes a tray table 117 and a tray table support assembly 119. As will be appreciated, one or more of the features described above for the tray table apparatus 10 may be incorporated into the tray table apparatus 110 as desired. The tray table apparatus 110 is shown in the deployed position, and the tray table apparatus 110 may be transitioned to a stowed position to be stowed within die upper storage compartment 113. The tray table support assembly 119 includes a support shelf 121 which includes two pair of pivot blocks 123, 123, each pair defining a pivot axis PA1, PA2. The pivot axes PA1, PA2 are parallel to each other and equidistantly spaced apart on opposite sides of the lateral centerline CL1 of the support shelf 121 The support arm 127 of the tray table support assembly 119 is pivotably coupled to the tray table 117 and to one of the two pair of pivot blocks 123, 125, so that the support arm 127 pivots, with respect to the support shelf 121, along one of the two pivot axes PA1, PA2. As shown, the pivot member 131 of the support arm 127 is coupled to the first pair of pivot blocks 123, and the coupling is achieved with a removable fastener, such as a locking pin, a thumb screw, a screw element with a knob on one end, or the like, so that the support arm 127 may be easily and quickly removed from the first pair of pivot blocks 123 and pivotably coupled to the second pair of pivot blocks 125. In doing so, the tray table apparatus 110 may be easily and quickly reconfigured, such as, for example, to be used with a bed positioned on either side of the night table 111. The tray table apparatus 110 is therefore provided with easy symmetrical reconfigurability, such that the two available deployed positions of the tray table apparatus 110, one when the support arm 127 is pivotably coupled to the first pair of pivot blocks 123 and the other when the support arm 127 is pivotably coupled to the second pair of pivot blocks 125, are symmetrical about the lateral centerline CL1 of the support shelf 121. The first and second stowed positions of the tray table apparatus 110 are also symmetrical about the lateral centerline CL1 of the support shelf 121.

Figure 13:
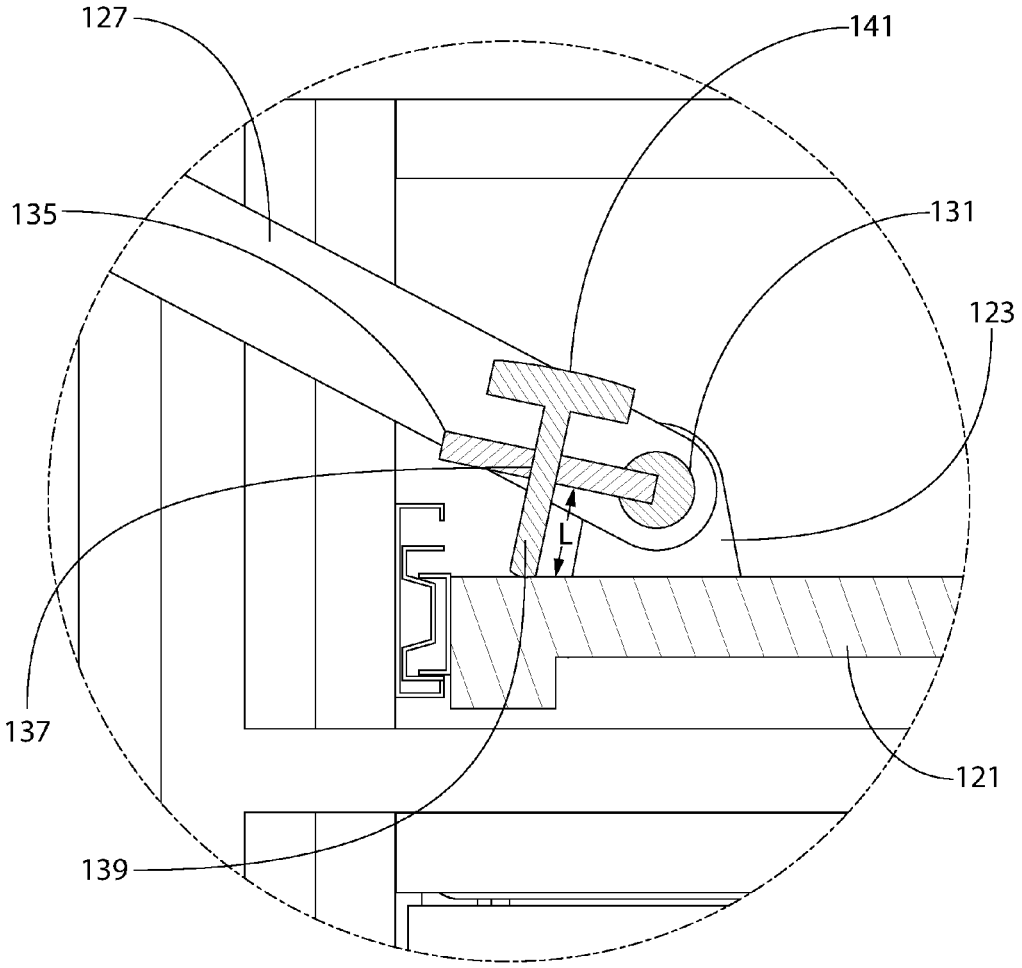
FIG. 13 is a sectional view of the tray table support assembly along the line XII-XII of FIG. 12, showing the adjustable pivot stop.

The tray table support assembly 119 also includes a pivot stop 133 which is affixed to the pivot member 131 of the support arm 127, as is shown in FIG. 13. The pivot stop 133 includes a plate 135 which is affixed to and rotates with the pivot member 131, and the plate 135 includes a threaded hole 137 therethrough. A screw element 139 is engaged with the threaded hole 137, such that a length L of the screw element extends entirely through the plate 135 to extend outward from both sides. A knob 141 is coupled to the screw element 139 on one side of the plate 135 to facilitate rotation of the screw element 139 by a user. The end of the screw element 139 extending from the plate 135 on the opposite side as the knob 141 is positioned to abut against the support shelf 121. With this configuration, the screw element 139 serves to limit the pivot motion of the support arm 127. Rotation of the knob 141 adjusts the length L of the screw element 139 extending beyond the bottom edge of the plate 135, such that the length L of the screw element 139 serves to determine the height of the tray table 117, e.g., the height of the tray table 117 above the bed, when the tray table support assembly 119 is in the deployed position.

Figure 14:
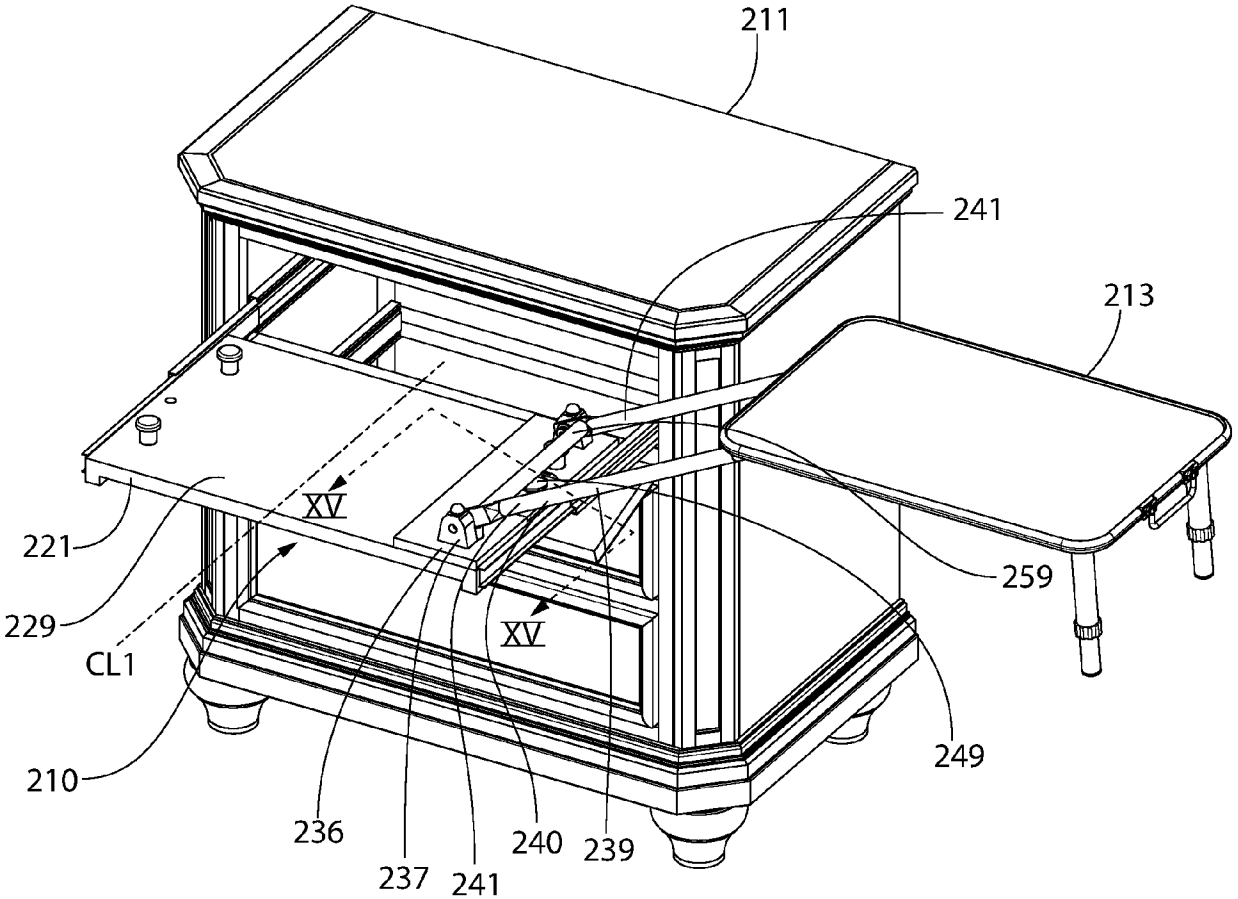
FIG. 14 is a perspective view of a third embodiment of the tray table apparatus having alternate support leg and height adjustment mechanisms.

A third embodiment of the tray table apparatus is shown in FIGS. 14-18. As best shown in FIG. 14, the tray table apparatus 210 is coupled with a night table 211. Once again, another article of furniture may be used in lieu of the night table 211. The tray table apparatus 210 includes a stowable tray table 213 a tray table support assembly 221, similar to the embodiment of FIG. 1. All other details not expressly discussed are identical to the embodiment of FIG. 1. The tray table support assembly 221 includes a support shelf 229, a base plate 236, and a support arm 239. The base plate 236 is removably coupled to the support shelf 229, and may be reversed depending on the side that the user desires the tray table 213 to be deployed. This allows conversion from a first configuration to a second configuration as discussed above with respect to FIG. 1. As before, in the first configuration, the tray table support assembly 221 and tray table 213 have a first stowed position whereby the tray table 213 is stowed within a storage compartment of the night table 211 and a first deployed state whereby the tray table 213 extends beyond a first side of the night table 211. In the second configuration, the tray table support assembly 221 and tray table 213 have a second stowed position whereby the tray table 213 is stowed within the storage compartment of the night table 211 and a second deployed state whereby the tray table 213 extends beyond a second side of the night table 211. In some embodiments, the first and second stowed positions may be identical. In other embodiments, the first and second stowed positions are symmetric with respect to a lateral centerline of the support shelf 229.

The base plate 236 comprises a pair of pivot blocks 237 which are joined to individual pivot members 241 of the support arm 239. The pivot members 241 extend from a first end 240 of the support arm 239 to the nay table 213. A pivot stop 249 on the base plate 236 engages a cross member 259 on the support arm 239 to enable the user to set the angle of the support arm 239 with respect to the support shelf 229. The cross member 259 extends between the two pivot members 241, and may be welded, or welded to the pivot members. In alternate embodiments, the cross member 259 may be attached by any known means.

Figure 15:
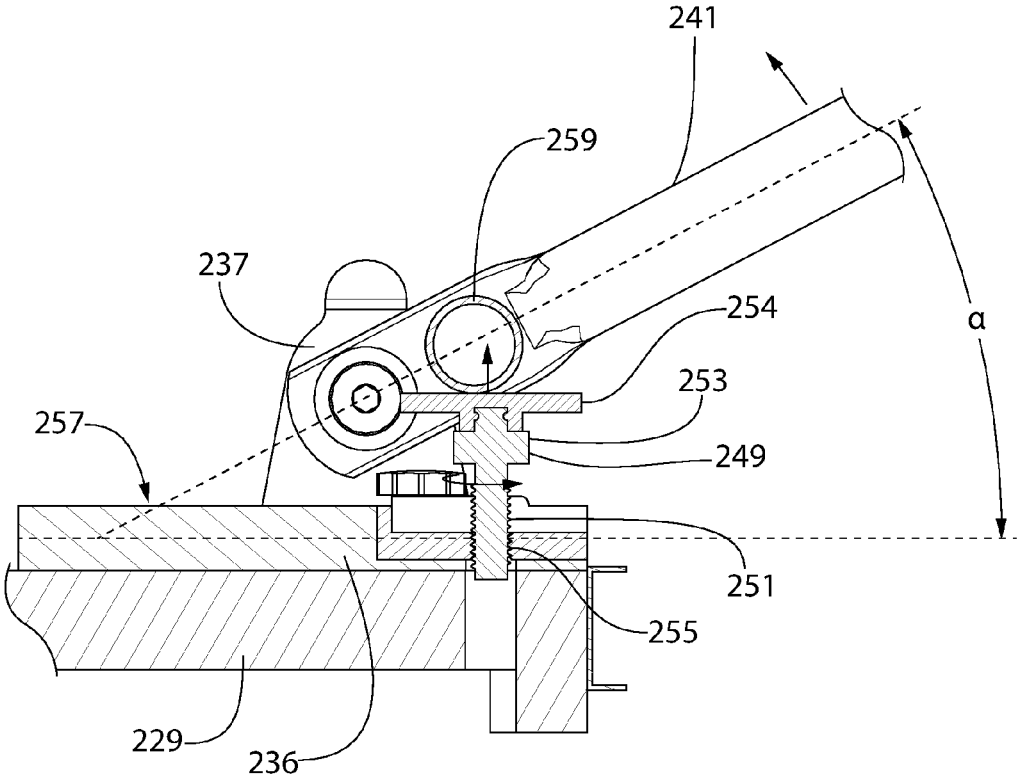
FIG. 15 is a sectional view of a portion of the tray table support assembly of the tray table apparatus of FIG. 14, showing the adjustable pivot stop.
Figure 18:
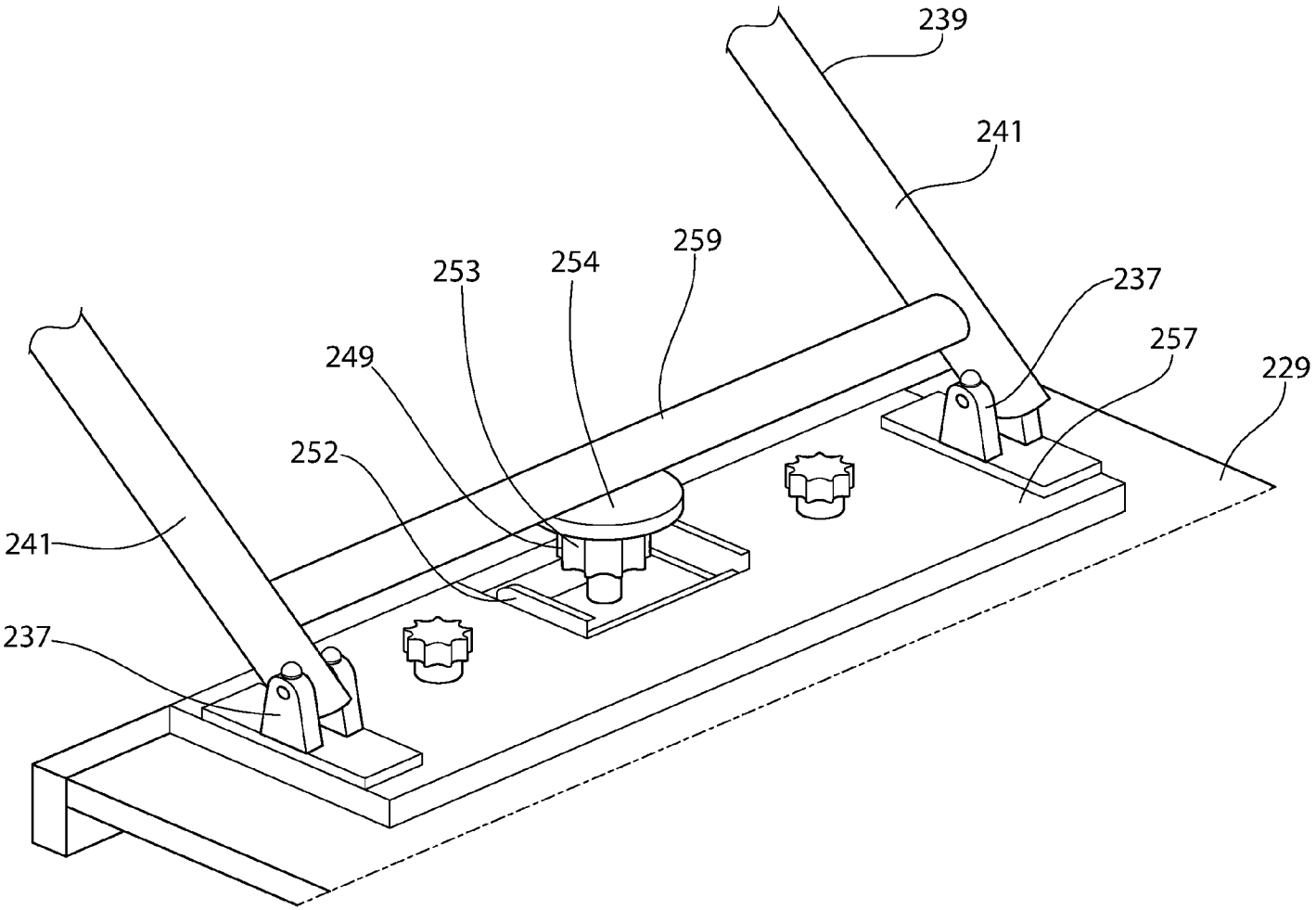
FIG. 18 is a perspective view of the base plate of the tray table apparatus of FIG. 4.

Turning to FIG. 15, a sectional view highlighting the adjustable pivot stop arrangement is shown. A perspective view of the adjustable pivot stop arrangement is also shown in FIG. 18. The pivot stop 249 consists of a screw element 251, a knob 253, and an adjustment cap 254. The knob 253 and the screw element 251 are fixedly attached to each other such that when the knob 253 is rotated, the screw element 251 also rotates. In some embodiments, the knob 253 and the screw element 251 are integrally formed. In other embodiments, the knob 253 is formed as a separate component and is glued, pressed, welded, or otherwise attached to the screw element 251. The adjustment cap 254 is attached to the top of the knob 253, and is able to freely rotate with respect to the knob 253. It may have interlocking features which ensure axial retention, or may merely be retained on the knob 253 by gravity. In yet other embodiments, the screw element 251 may extend through the knob 253 such that the adjustment cap 254 engages the screw element 251 and is free to rotate with respect to the screw element 251.

The screw element 251 engages a threaded receptacle 255 in an adjustment well 252. In some embodiments, the threaded receptacle 255 is formed as threads in the adjustment well 252. In other embodiments, a separate component containing threads is mounted to the adjustment well 252, such as by pressing, gluing, or other known techniques. In yet further embodiments, the threaded receptacle 255 may be formed in the base plate 236 or the support shelf 229. The adjustment well 252 is formed as a tray having one open side to allow the user to easily reach the knob 253 for adjustment. The other three sides of the adjustment well 252 may be formed with walls having stepped and radiused corners, a taper, or other features to guide the user's hand to the adjustment knob 253 without the need to visually locate the adjustment knob 253.

As with the embodiment of FIG. 1, the base plate 236 has a top surface 257 onto which the pivot blocks 2 3 7 are mounted. The support arm 239 is therefore able to rotate at the first end 240. The cross member 259 engages with the adjustment cap 254 so that the angle of the support arm 239 is set by turning the knob 253, which raises the adjustment cap 254. This moves the cross member 259 upward, adjusting the angle at which the support arm 239 rests when in the first or second deployed position. The adjustment cap 254 facilitates free rotation of the knob 251 because the friction between the adjustment cap 254 and the knob 253 can be controlled independent of the friction between the adjustment cap 254 and the cross member 259. In sonic embodiments, a thrust bearing or other device may be used to minimize the friction between the adjustment cap 254 and the knob 253 to minimize the torque required to set the angle of the support arm 239.

Figure 16:
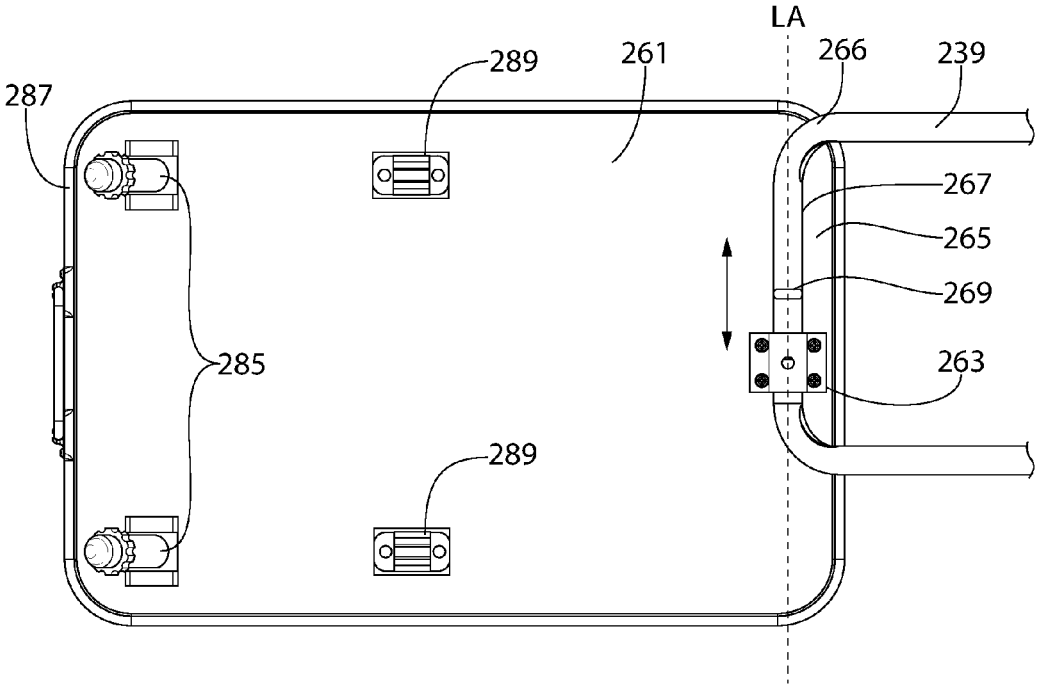
FIG. 16 is an elevation view of the bottom of the tray table of the tray table apparatus of FIG. 14.

Turning to FIG. 16, a view of the underside of the tray table 213 is shown. As can be seen, the tray table 213 has a first end 265 proximal the support arm 239 and a second end 287. The second end 287 has a pair of support legs 285 which engage a pair of corresponding leg clips 289. The leg clips 289 allow the support legs 285 to be stowed when the tray table 213 is folded for storage. When the tray table 213 is deployed, the support legs 285 are folded down, releasing them from the leg clips 289, such that they extend away from a plane formed by the bottom surface 261 of the tray table 213.

Proximate the first end 265, the tray table 213 also <has a tray pivot block 263 which engages a pivot member 267 located at a second end 266 of the support arm 239, the second end 266 being opposite the first end 240. This allows the tray table 213 to rotate about a longitudinal axis LA, permitting the deployment and stowage of the tray table 213. The pivot member 267 and the tray pivot block 263 also form a sliding joint. This permits the tray table 213 to be translated along the longitudinal) axis LA so that the tray table 213 may be moved toward or away from the user with respect to the support arm 239. The pivot member 267 further comprises an indent 269 which provides tactile feedback to the user when the user has moved the tray table 213 to the correct position for stowage of the tray table 213 The indent 269 and the tray pivot block 263 are illustrated as being in the middle of the support arm 239 and the tray table 213 respectively. However, in alternate embodiments one or both of the indent 269 and the tray pivot block 263 may be moved. This may provide a more desirable range of motion of the tray table 213 when in the deployed position. In yet other embodiments, the indent 269 may be eliminated.

Figure 17:
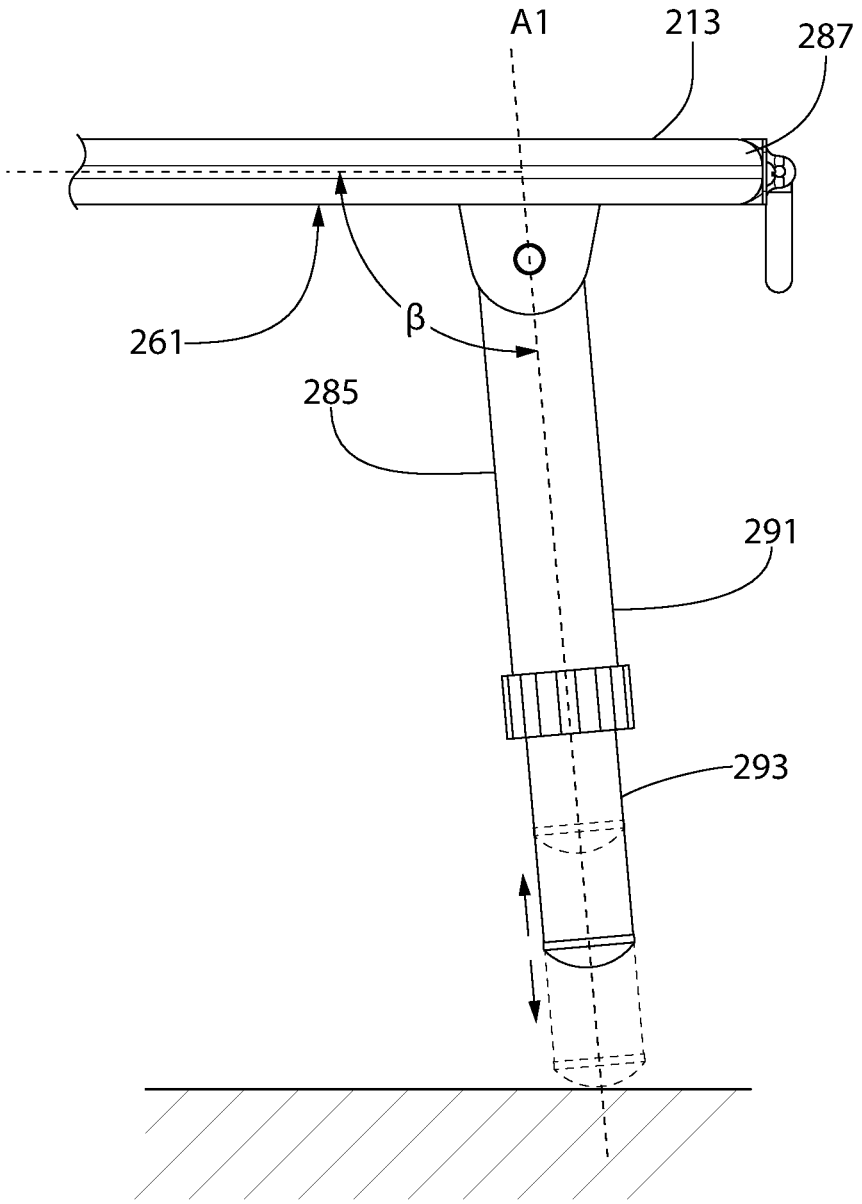
FIG. 17 is an elevation view of the support leg for the tray table of the tray table apparatus of FIG. 14.

As best shown in FIG. 17, the support legs 285 consist of first and second leg: segments 291, 293. The second leg segments 293 may be moved along the leg axis A1 of the respective support legs 285 to adjust the length of the support legs 285. As can be seen, the support legs 285 are not perpendicular to the tray table 213, but splay outward slightly toward the second end 287 of the tray table 213 at an angle β. The angle β is greater than 90 degrees, and is preferably between 91 and 105 degrees. Most preferably, the angle β is 95 degrees. By angling the support legs 285 outward toward the second end 287, the support legs 285 are resistant to accidental folding while in use. The two support legs 285 better stabilize the tray table 213 and more readily conform to uneven surfaces.

In other embodiments, the support legs 285 may be formed as a single member having a single length adjustment for two or more separate contact points, a single member having individual length adjustments for two or more separate contact points, or a single member that is non-adjustable. Most preferably, where two support legs 285 are utilized, they are arranged at the corners of the tray table 213 rather than along a longitudinal centerline of the tray table 213. In yet other embodiments, it is conceived that the support legs 285 are positioned non-symmetrically about a longitudinal centerline of the tray table 213.

Turning to FIGS. 19A, 19B, 20A, 20B, and 21, a fourth embodiment of the tray table apparatus is disclosed, showing only the tray table support assembly 321 and corresponding drawer slides 333. The tray table and all other details are identical to that shown in the embodiment of FIG. 1. In this embodiment, the tray table support assembly 321 has a support shelf 329 and a support arm 339. In this embodiment, the base plate has been eliminated because the support arm 339 is mounted directly to the support shelf 329. The support shelf 329 has a first side 395 and a second side 397. The support shelf 329 is removably detachable from a pair of slide brackets 322 which are mounted on drawer slides 333. The slide brackets 322 have engagement pins 324 which protrude upward and slideably engage engagement holes 32.6 formed into the support shelf 329. The support shelf 329 is engaged with the slide brackets 322 by translating the support shelf 329 downward, causing the engagement holes 326 and engagement pins 324 to engage each other. The support shelf 329 is then retained by gravity. This allows rapid removal of the tray table support assembly 321 from the drawer slides 333. In some embodiments, the engagement pins 324 and engagement holes 326 have retention features so that the support shelf 329 is retained on the slide brackets 322. These retention features may take the form of snaps, bolts, screws, or any other known means. However, it is preferred that they be easy to engage and disengage the support shelf 329 from the slide brackets.

In some embodiments, there is only one engagement pin 324 and engagement hole 326 per slide bracket 322. In yet other embodiments, there are more than two engagement pins 324 and engagement holes 326 per slide bracket 322. In further embodiments, the engagement pins 324 and engagement holes 326 may not be circular, but instead may take the shape of a square, a slot with radiused ends, or another shape that permits engagement of the support shelf 329 with the slide brackets 322. The engagement holes 326 need not extend all the way through the support shelf 329. In alternate embodiments, the engagement pins 324 and the engagement holes 326 may be reversed such that the engagement pins 324 are arranged on the support shelf 329. In yet further variations, the engagement pins 324 and engagement holes 326 may be features arranged into the insides of the slide brackets 322 which permit the support shelf 329 to engage the slide brackets 322. Yet other embodiments may have a plurality of engagement features 324 and engagement holes 326 such that the support shelf 329 may be repositioned with respect to the slide brackets 322 along the longitudinal axis of the drawer slides 333.

Figure 19A:
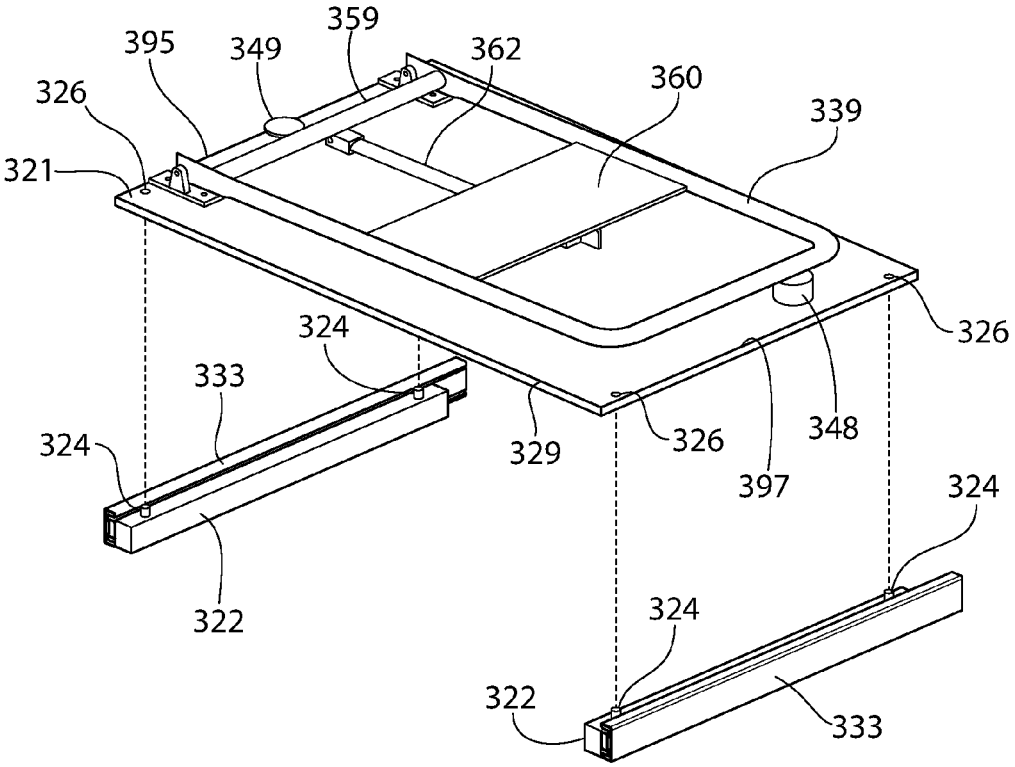
FIG. 19A is a perspective view of a base plate and support arm assembly in a first orientation according to a fourth embodiment of the invention showing the base plate separated from the drawer slides.
Figure 19B:
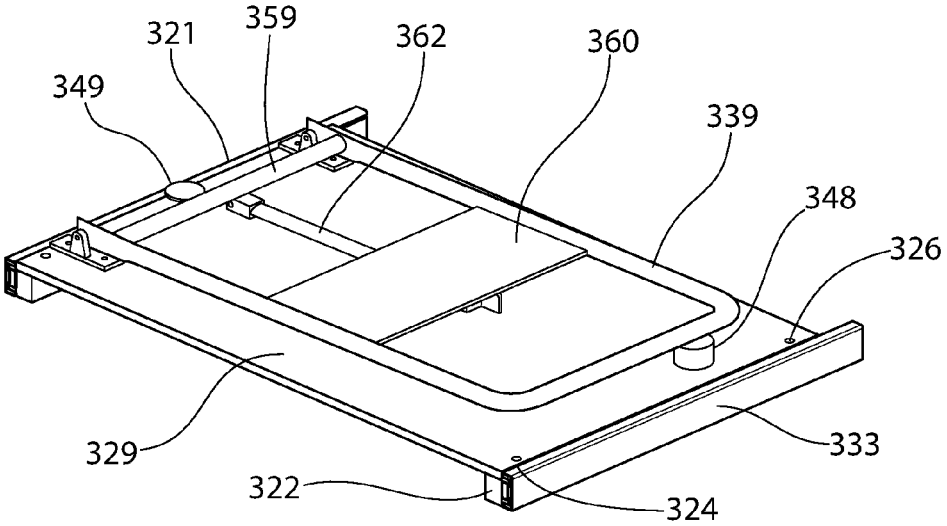
FIG. 19B is a perspective view of the base plate and support arm assembly mated to the drawer slides in the first orientation according to the embodiment of FIG. 19A.
Figure 20A:
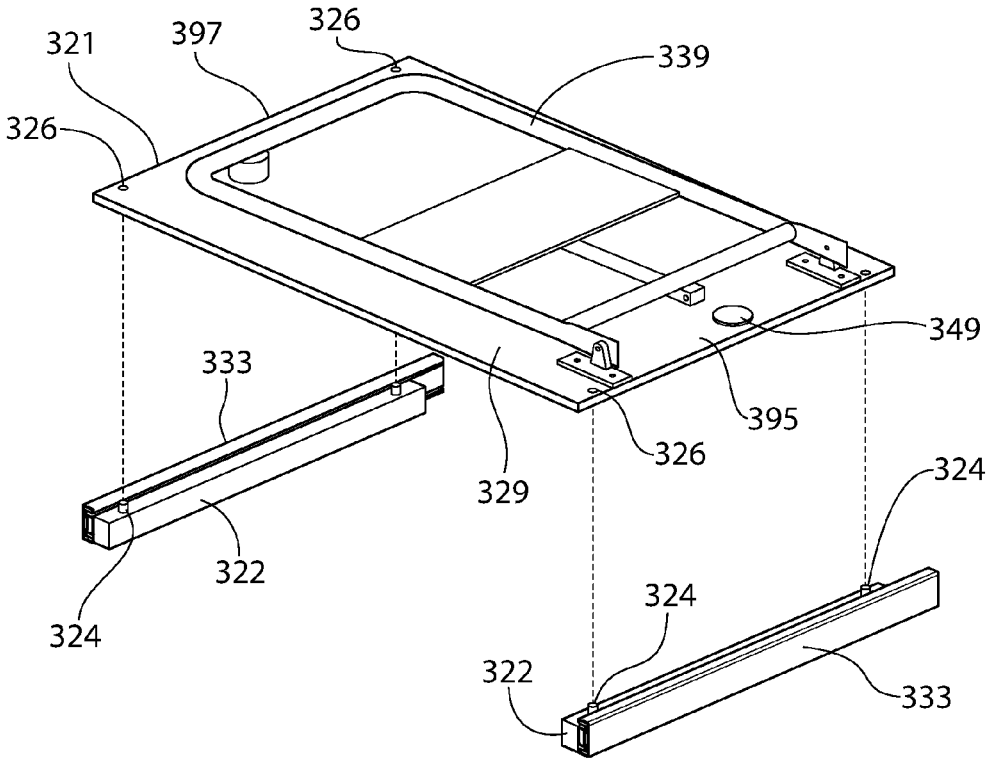
FIG. 20A is a perspective view of the base plate and support arm assembly separated from the drawer slides according to the embodiment of FIG. 19A in a second orientation.
Figure 20B:
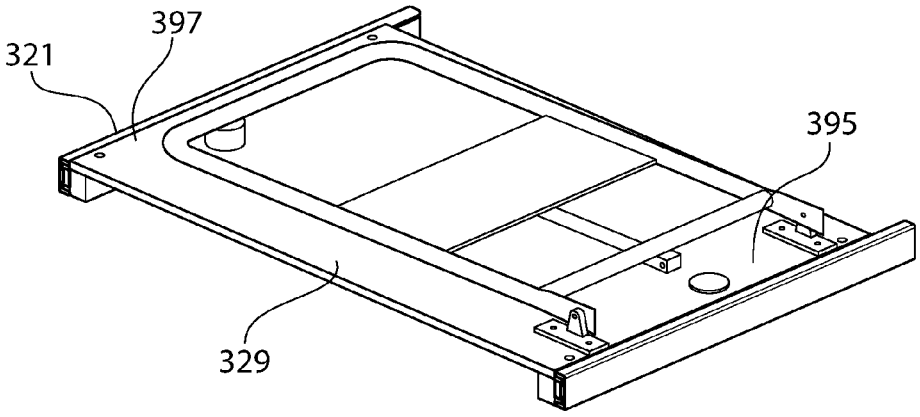
FIG. 20B is a perspective view of the base plate and support arm assembly mated to the drawer slides in the second orientation according to the embodiment of FIG. 19A.
Figure 21:
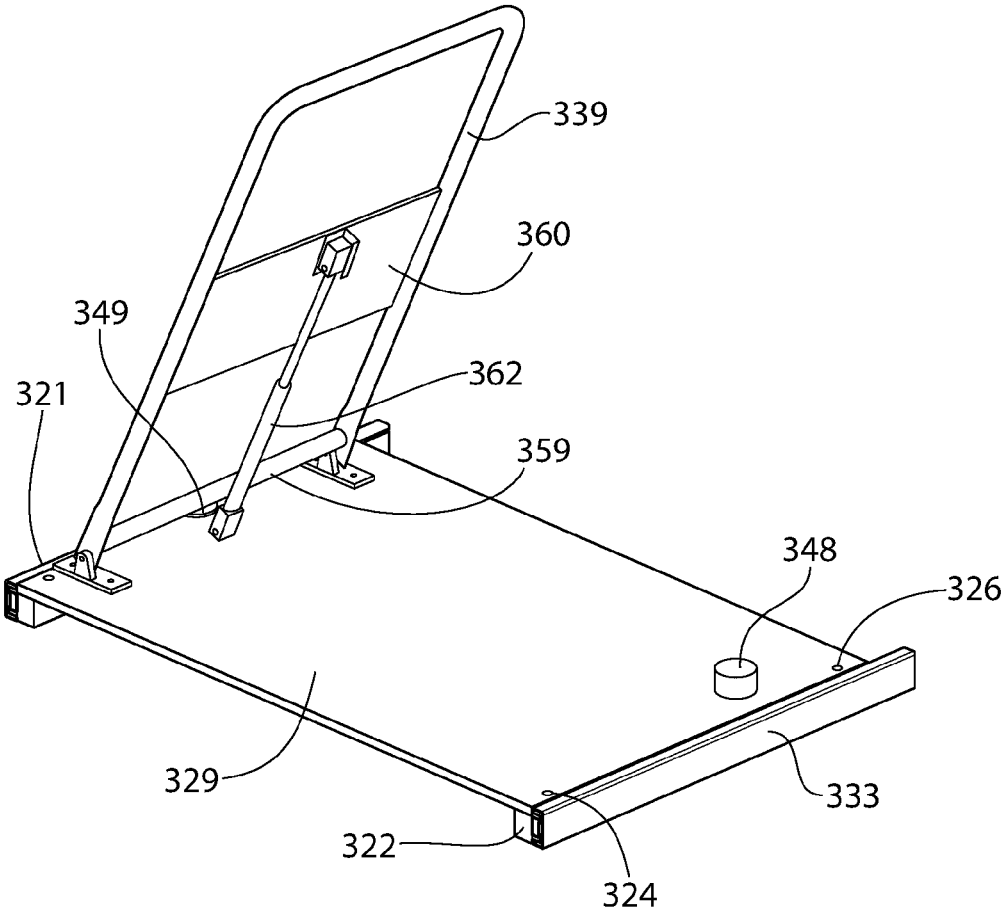
FIG. 21 is a perspective view of the base plate and support arm assembly according; to the embodiment of FIG. 19A, where the support arm is partially deployed.

In FIGS. 19A and 19B, the support shelf 329 is arranged in a first configuration such that the second side 397 is toward the right as viewed by a user facing the tray table apparatus. In FIGS. 20A and 20B, the support shelf 329 is arranged in a second configuration such that the second side 397 is toward the left as viewed by a user facing the tray table apparatus. Accordingly, it is possible to reconfigure the tray table apparatus such that the tray table is adapted to fold out either side of the tray table apparatus, depending, on the side of the bed where it is intended to be used. As can be seen, FIGS. 19A and 19B demonstrate the tray table support assembly in a first stowed position and FIGS. 20A and 2011 demonstrate the tray table support assembly in a second stowed position.

As can be seen, the embodiment of FIGS. 19A, 19B, 20A, 20B, and 21 also has an adjustable pivot stop 349 which engages the cross member 359 of the support arm 339 when the tray table is deployed. At the second side 397 of the support shelf 329, a single support block 348 ensures that the support arm 339 rests at the desired position when the tray table is stowed. Only a single support block 348 is required, as the support arm 339 has sufficient rigidity that further support is not required. In some embodiments, the support block 348 is formed of a resilient material. In other embodiments it has a resilient element formed thereon, or is entirely formed of a rigid material such as wood or plastic.

The present embodiment is further modified to incorporate a support plate 360, the support plate 360 being rigidly attached to the rest of the support arm 339. The support plate 360 greatly improves stiffness of the support arm 339 and reduces the deflection of the support arm 339 in use. This increased rigidity gives the impression of greater quality without appreciably increasing the weight. The support plate 360 is welded, glued, riveted, or bolted to the rest of the support arm 339. Any other known attachment means may be used.

The present embodiment fluffier comprises a spring element 362 which attaches between the support arm 339 and the support shelf 329. In the present embodiment, the spring element 362 is attached between the support plate 360 and the support shelf 329. The spring element 36.2 provides a force which assists the deployment and stowage of the tray table. When stowing the tray table, the spring element 362 provides a force which resists the compression of the spring element 362. This serves to reduce the apparent weight of the support arm 339 and the tray table. Not only does this make it easier for users to stow the tray table, but it reduces the likelihood that the tray table will crash down onto the support shelf 329. This is particularly valuable when used at night, where quiet operation is particularly desirable.

During deployment, the force applied by the spring element 362 assists deployment because it also provides a force which assists the unfolding. In the preferred embodiment, the force provided by the spring element 362 is less than the force required to deploy the tray table. Thus, the tray table does not self-deploy. Furthermore, the arrangement of the spring element 362 can be adjusted to provide different levels of assistance at different positions of the support arm 339. In the present configuration, the spring element 362 provides the least assistance when the tray table and support arm 339 are in the first or second stowed positions, and provides greater assistance as the tray table and support arm 339 are unfolded toward the first or second deployed positions. The spring element 362 may be a gas spring, a coil spring, or any other type of conventional spring element capable of providing a force which resists compression. In some other embodiments, the spring element 362 may also provide a damping force. This can be particularly valuable for ensuring that the tray table does not crash down onto the support shelf 329 during stowage.

It is conceived that either the spring element 362 or the support plate 360 be eliminated in alternate embodiments. The spring element 362 may be attached to another portion of the support arm 339 if the support plate 360 is not required. :In these embodiments, the spring clement 362 might be offset to one side, rather than arranged along the longitudinal centerline of the support shelf 329. Alternately, the support plate 360 may be used, but the spring element 362 may be eliminated if the weight of the tray table and the support arm 339 are not so heavy as to require additional support or cost reduction is deemed a higher priority.

Figure 22:
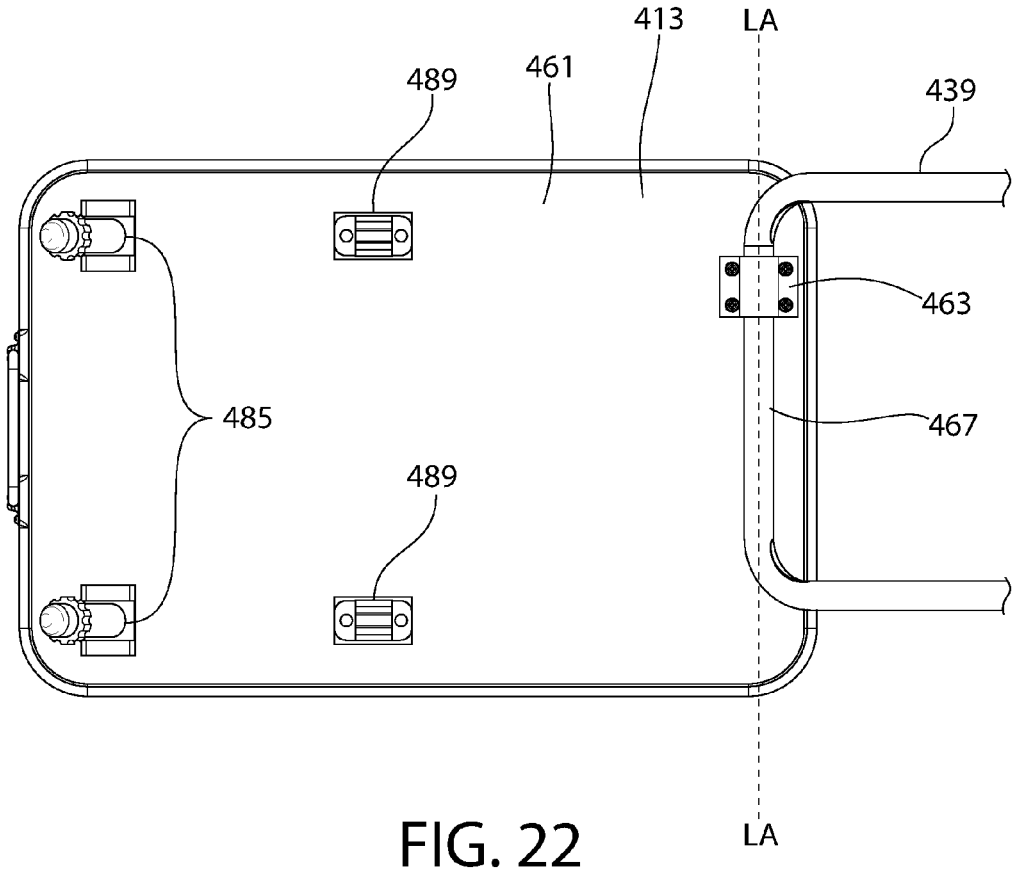
FIG. 22 is an elevation view of the bottom of the tray table of the tray table apparatus according to a fifth embodiment of the invention showing a modified support arm and pivot block.
Figure 23:
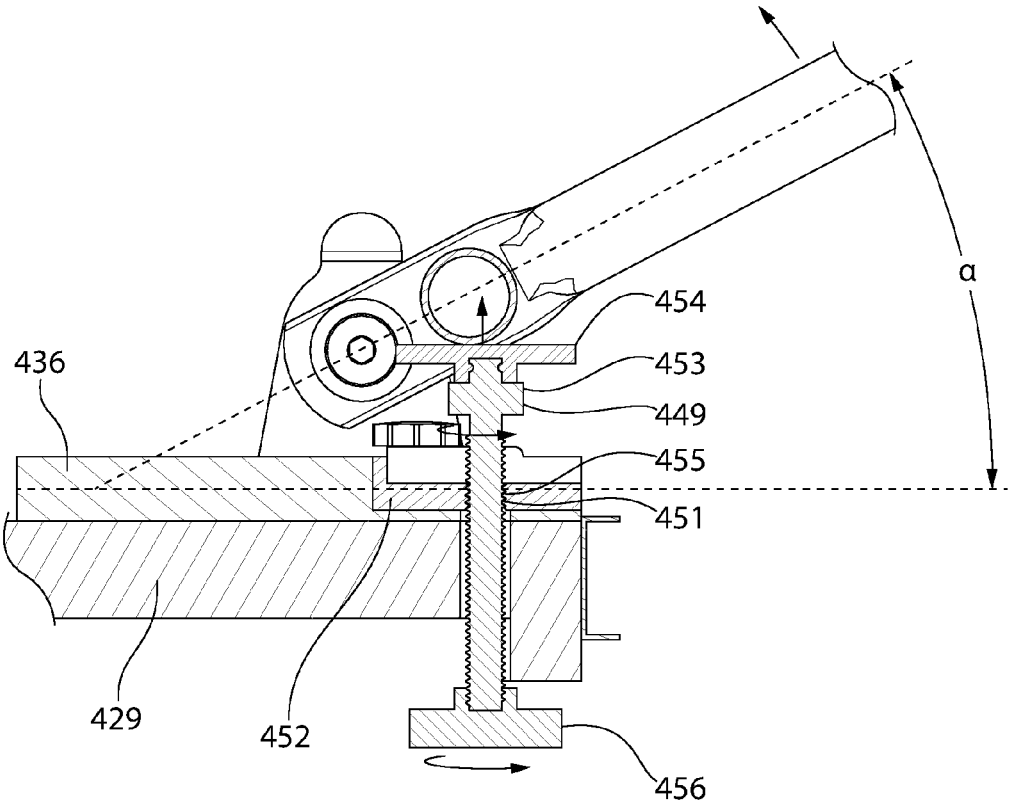
FIG. 23 is a sectional view of a portion of the tray table support assembly according to the embodiment of FIG. 22 showing an alternate adjustable pivot stop.

In FIGS. 22 and 23, a fifth embodiment of the tray table apparatus is disclosed which has a modified support arm and pivot block arrangement. This is a variation of FIG. 14, with all details not expressly disclosed being identical to that of FIG. 14. FIG. 22 shows the underside of the tray table apparatus. The tray table apparatus has a support arm 439 and a tray table 413, similar to the previous embodiments. As before, the tray table 413 has a pair of support legs 485 which engage with a corresponding pair of leg clips 489 on a bottom surface 461 of the tray table 413. The support arm 439 has a pivot member 467 at the end of the support arm 439. The pivot member 467 engages with a tray pivot block 463. However, there is no indent formed into the pivot member 467. Instead, the pivot block 463 is positioned offset from the longitudinal centerline of the tray table 413 toward the night table. This enables the user to slide the tray table 413 away from the user when it is deployed, but, not slide the tray table 413 closer to the user. Instead, the pivot block 463 hits the end of the pivot member 467 and cannot be translated any further along the longitudinal axis LA. Because the user is rarely expected to need the tray table 413 any closer than the front surface of the night table, this only increases the effective adjustment range of the apparatus without any corresponding loss of function or increase in size of the apparatus.

When the pivot block. 463 is properly positioned, the indent can be successfully eliminated without any loss of functionality. Other embodiments utilize the indent to provide an indication of the proper positioning of the tray table 413 with respect to the support arm 439 for stowing the tray table 413. However, the present embodiment merely requires that the tray table 413 be translated until the pivot block 463 reaches the end of the pivot member 467. The tray table 413 can then be folded without risk of impact with the night table. Even if the tray table 413 is not translated until it stops, the tray table 413 will merely extend further out away from the night table than desired. No damage will result from the failure to position the tray table 413 in the proper position prior to stowage.

Turning to a sectional view of the pivot stop arrangement of the fifth embodiment is shown. As can be seen., the tray table apparatus has a support shelf 429, on which a base plate 436 is mounted. An adjustment well 452 sits within the base plate and engages a pivot stop 449. The pivot stop 449 engages the support arm in the same manner as with other embodiments of the invention, but is constructed in a slightly different manner. The pivot stop 449 has a screw element 451 coupled to a threaded receptacle 455 in the adjustment well 452. The pivot stop 449 further comprises a knob 453, an adjustment cap 454, and a lower knob 456. The knob 453 allows adjustment from above the support shelf 429, and is rigidly coupled to the screw element 451. Similarly, the lower knob 456 is also rigidly coupled to the screw element 451 to permit adjustment from underneath the support shelf 429. The adjustment cap 454 is free to rotate with respect to the screw element 451. Thus, the user may have the option of, adjusting the pivot stop 449 on either side of the support shelf 429. In alternate embodiments, the knob 453 is eliminated and only the lower knob 456 retained. The knob 453 and the lower knob 456 may be attached in any known means, including gluing, welding, interlocking features, and the like.

Other embodiments of the tray table apparatus are conceived, such as the use of a centrally located pivot. Rather than causing the support arm to rotate about one side of the support shelf, it is conceived that this rotation may occur along the centerline of the support shelf. The support arm may then be reconfigured such that it is a linkage which pivots about the lateral centerline of the support shelf and is reversible without the need to detach the support shelf or the base plate from the rest of the apparatus. In this embodiment, the first and second stowed positions may be identical. This may result in a support arm consisting of more than two separate links, either one of the links being adapted to telescope. In yet other embodiments, the support arm may consist of multiple links which can be folded in different arrangements to permit transitioning from a first deployed position to a second deployed position.

In yet other embodiments, the support arm may be configured to pivot, such that it can be swiveled from the first configuration to the second configuration. Thus, the support arm may be rotatable about an axis, the axis being perpendicular to a plane formed between the drawer slides, such as the plane formed by the upper surface of the support shelf It may be possible to provide detent features which latch the support arm in the first configuration or the second configuration. Other embodiments may utilize reversible drawer slides or reversible furniture which allows the apparatus to be reconfigured from the first configuration to the second configuration. Furthermore, in any of the above embodiments, a "holdout slide" may be used for the drawer slides to ensure that the drawer slides do not retract while the tray table is deployed. This can help to ensure that the tray table maintains the user-set position and does not inadvertently retract while in use.

While the invention has been described with respect to specific examples including presently preferred modes of carrying out the invention, those Skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A tray table apparatus comprising:

a furniture support structure having a storage compartment; and a tray table support assembly coupled to, a tray table and to the furniture support structure, the tray table and the tray table support assembly alterable between: (1) a first configuration in which the tray table and the tray table support assembly can be transitioned between: (a) a first stowed position in which the tray table and the tray table support assembly are at least partially disposed within the storage compartment, and (b) a first deployed state in which the tray table is outside of the storage compartment and extends from a first side of the furniture support structure so that one or more articles can be supported by the tray table; and (2) a second configuration in which the tray table and the tray table support assembly can be, transitioned between: (a) a second stowed, position in which the tray table and the tray table support assembly are at least partially disposed within the storage compartment, and (b) a second deployed state in which the tray table is outside of the storage compartment and extends from a second side of the furniture support structure so that one or more articles can be supported by the tray table, the second side being opposite the first side.

2. The tray table apparatus of claim 1, the tray table support assembly further comprising a support shelf and a support arm, wherein in the first stowed position, the support shelf the support arm, and the tray table are positioned in a plurality of parallel planes.

3. The nay table apparatus of claim 1, the tray table support assembly further comprising a first support leg pivotably coupled to a bottom surface of the tray table;

wherein the first support leg is configured to be adjustable in length.

4. The tray table apparatus of claim 3, the tray table support assembly further comprising a second support leg pivotably coupled to a bottom surface of the tray table.

5. The tray table apparatus of claim 3, the tray table support assembly further comprising a leg clip coupled to the bottom surface of the tray table.

6. The tray table apparatus of claim 5, wherein the first support leg is coup led to the lea clip when the tray table support assembly is in the first stowed position.

7. The tray table apparatus of claim 1, wherein in the first deployed, state, the first support leg is positioned at kin angle with respect to the tray table, the angle being greater than 90 degrees.

8. The tray table apparatus of claim 1, the tray table support assembly further comprising an adjustable pivot stop, the adjustable pivot stop comprising a knob and an adjustment cap, the adjustment cap being free to rotate with respect to the knob.

9. The tray table apparatus of claim 8, wherein the tray table support assembly further comprises a support arm, the support arm comprising a cross member which engages the adjustment cap when the tray table support assembly is in the first deployed state.

10. The tray table apparatus of claim 1, wherein the tray table support assembly further comprises a support arm the support arm comprising a support plate.

11. The tray table apparatus of claim 1, wherein the tray table support assembly further comprises a support shelf, a support arm, and a spring element, the spring element connected between the support shelf and to the support arm.

12. The tray table apparatus of claim 1, the tray table support assembly further comprising a support arm and a pivot block, the pivot block offset from a longitudinal centerline of the tray table.

13. A tray table apparatus comprising:

a furniture support structure having a storage compartment; and a tray table support assembly coupled to a tray table and to the furniture support structure, the tray table and the tray table support assembly alterable between: (1) a stowed position in which the tray table and the tray table support assembly are at least partially disposed within the storage compartment; (2) a first deployed state in which the tray table is outside of the storage compartment and extends from a first side of the furniture support structure so that one or more articles can be supported by the tray table; and (3) a second deployed state in which the tray table is outside of the storage compartment and extends from a second side of the furniture support structure so that one or more articles can be supported by the tray table, the second side being opposite the first side.

14. The tray table apparatus of claim 13, the tray table support assembly further comprising a support shelf and a support arm, wherein in the stowed position, the support shelf, the support arm, and the tray table are positioned in a plurality of parallel planes.

15. The tray table apparatus of claim 13, the tray table support assembly further comprising a first support leg pivotably coupled to a bottom surface of the tray table;

wherein the first support leg is configured to be adjustable in length.

16. The tray table apparatus of claim 15, the tray table, support assembly further comprising a second support leg pivotably coupled to the bottom surface of the tray table.

17. The tray table apparatus of claim 15, the tray table support assembly further comprising a leg clip coupled to a bottom surface of the tray table.

18. The tray table apparatus of claim 17, wherein the first support leg, is coupled to the leg clip when the tray table support assembly is in the stowed position.

19. The tray table apparatus of claim 15, wherein in the first deployed state, the first support leg is positioned at an angle with respect to the tray table, the angle being greater than 90 degrees.

20. The tray table apparatus of claim 1, the tray table support assembly further comprising an adjustable pivot stop, the adjustable pivot stop comprising a knob and an adjustment cap, the adjustment cap being free to rotate with respect to the knob.

* * * * *